US005547052A

United States Patent [19]

Latshaw

[11] Patent Number: 5,547,052

[45] Date of Patent: Aug. 20, 1996

[54] MODULAR WHEELED LUGGAGE SYSTEM, WHEELED LUGGAGE, GARMENT BAG AND CONNECTOR FOR SAME

[75] Inventor: Ricky J. Latshaw, Republic, Mo.

[73] Assignee: Purdy Neat Things Company, Inc., Republic, Mo.

[21] Appl. No.: 353,195

[22] Filed: Dec. 9, 1994

[51] Int. Cl.[6] ..... A45C 5/14; A45C 13/22; A45C 13/30; A45C 13/38

[52] U.S. Cl. ..... 190/108; 190/18 A; 190/102; 190/115; 190/15.1; 206/287.1; 206/290; 206/293; 16/115

[58] Field of Search ..... 190/18 A, 102, 190/108, 115, 39, 15.1; 206/278, 279, 290, 292, 294, 287.1; 16/115

[56] References Cited

U.S. PATENT DOCUMENTS

| | | | |
|---|---|---|---|
| Re. 28,757 | 4/1976 | Cassimally | 280/37 |
| Re. 29,036 | 11/1976 | Hager | 280/37 |
| Re. 34,474 | 12/1993 | Lutz | 206/207.1 |
| 2,626,689 | 1/1953 | Davis et al. | 206/287.1 |
| 2,925,283 | 2/1960 | Stilger | 280/37 |
| 3,057,636 | 10/1962 | D'Ettorre et al. | 280/37 |
| 3,061,057 | 10/1962 | Miller | 190/111 X |
| 3,564,590 | 2/1971 | Hebel | 206/207 X |
| 3,841,650 | 10/1974 | Miskelly | 280/37 |
| 3,960,252 | 6/1976 | Cassimally | 190/18 A |
| 3,967,708 | 7/1976 | Gregg et al. | 190/109 |
| 4,170,282 | 10/1979 | Schwartzstein | 190/108 X |
| 4,206,835 | 6/1980 | Shapiro | 206/287 X |
| 4,212,377 | 7/1980 | Weinreb | 190/109 |
| 4,244,453 | 1/1981 | Herz | 206/287 X |
| 4,314,624 | 2/1982 | Royet | 190/18 A |
| 4,383,141 | 5/1983 | Walker | 190/18 A |
| 4,406,353 | 9/1983 | Walker | 190/18 A |
| 4,420,068 | 12/1983 | Gerch | 190/102 |
| 4,424,841 | 1/1984 | Smith | 190/102 X |
| 4,436,189 | 3/1984 | Baum | 190/108 |
| 4,489,829 | 12/1984 | Myers et al. | 206/287 |
| 4,550,813 | 11/1985 | Browning | 190/18 A |
| 4,575,109 | 3/1986 | Cowdery | 280/37 |
| 4,598,803 | 7/1986 | Ghiassi | 190/108 |
| 4,618,035 | 10/1986 | Mao | 190/18 A |
| 4,621,404 | 11/1986 | Browning | 190/18 A X |

(List continued on next page.)

FOREIGN PATENT DOCUMENTS

| | | | |
|---|---|---|---|
| 664476 | 3/1988 | Switzerland | 190/108 |
| 440673 | 1/1936 | United Kingdom | 206/287 |
| 9319636 | 10/1993 | WIPO | 206/287.1 |

*Primary Examiner*—Sue A. Weaver
*Attorney, Agent, or Firm*—Bell, Seltzer, Park & Gibson

[57] ABSTRACT

A modular wheeled luggage system of the present invention has major components particularly sized to be positioned either underneath or in the overhead storage area above a passenger's seat in a passenger compartment of an airplane. A first major component of the luggage system preferably is a first piece of luggage having overall respective length, width, and depth dimensions of no greater than 24-inches by 16-inches by 10-inches. The first piece of luggage includes a body portion, wheels connected to lower end portions of the body portion, and a luggage connector detachably connected to the body portion for detachably connecting additional luggage thereto. A second major component preferably includes second and third pieces of luggage connected together and sized to have overall respective length, width, and depth dimensions no greater than 24-inches by 16-inches by 10-inches. The second piece of luggage preferably is detachably connected to the luggage connector of the first piece of luggage, positioned adjacent and overlying portions of the body portion of the first piece of luggage, and sized so that the second piece of luggage has dimensions substantially no greater than the body portion of the first piece of luggage. The third piece of luggage preferably is connected to the second piece of luggage and sized so that the luggage case has dimensions substantially no greater than either the second piece of luggage or the body portion of the first piece of luggage.

24 Claims, 16 Drawing Sheets

U.S. PATENT DOCUMENTS

| | | | |
|---|---|---|---|
| 4,673,070 | 6/1987 | Ambal | 190/108 |
| 4,736,839 | 4/1988 | King | 206/287.1 |
| 4,738,340 | 4/1988 | Crespi | 190/18 R |
| 4,753,329 | 6/1988 | Choy | 190/111 |
| 4,753,342 | 6/1988 | Pulichino, Jr. et al. | 206/291 |
| 4,759,431 | 7/1988 | King et al. | 190/18 A |
| 4,817,802 | 4/1989 | Pratt | 206/579 |
| 4,825,985 | 5/1989 | Kim | 190/111 |
| 4,836,343 | 6/1989 | Arney | 190/108 |
| 4,852,783 | 8/1989 | Bryden et al. | 224/253 |
| 4,854,431 | 8/1989 | Pulichino, Jr. | 206/280 X |
| 4,887,700 | 12/1989 | Rice | 190/111 |
| 4,898,274 | 2/1990 | Stout et al. | 206/289 |
| 4,911,271 | 3/1990 | Stanley | 190/102 |
| 4,915,220 | 4/1990 | Pulichino, Jr. | 206/278 |
| 4,925,021 | 5/1990 | Pulichino, Jr. | 206/277 |
| 4,971,194 | 11/1990 | Inagaki | 206/278 |
| 4,995,487 | 2/1991 | Plath | 190/18 A |
| 4,998,603 | 3/1991 | Nordstrom | 190/18 A |
| 5,000,301 | 3/1991 | Grenier | 190/127 |
| 5,031,766 | 7/1991 | Cohen | 206/289 |
| 5,042,664 | 8/1991 | Shyr et al. | 206/579 |
| 5,048,649 | 9/1991 | Carpenter et al. | 190/18 A |
| 5,054,589 | 10/1991 | Bomes et al. | 190/18 A |
| 5,108,119 | 4/1992 | Huang | 280/37 |
| 5,117,974 | 6/1992 | Bieber | 206/278 |
| 5,159,999 | 11/1992 | Voigt | 190/111 |
| 5,167,306 | 12/1992 | Carrigan, Jr. | 190/18 A |
| 5,178,245 | 1/1993 | Cox | 190/107 |
| 5,197,525 | 3/1993 | Cantor | 190/108 X |
| 5,240,106 | 8/1993 | Plath | 206/316.2 |
| 5,295,565 | 3/1994 | Latshaw | 190/18 A |
| 5,330,049 | 7/1994 | Bertelsen et al. | 206/279 |

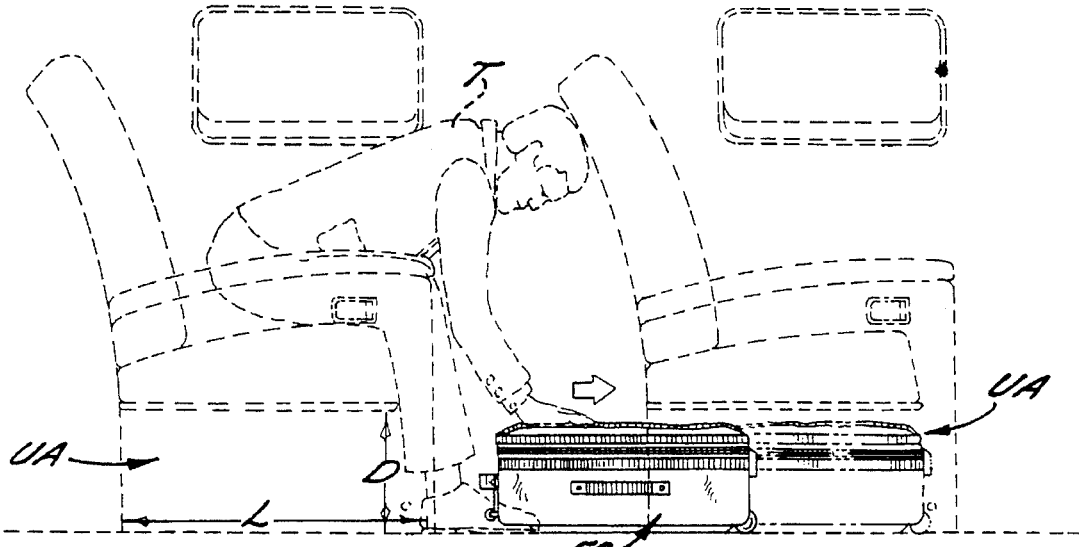
Fig. 5.
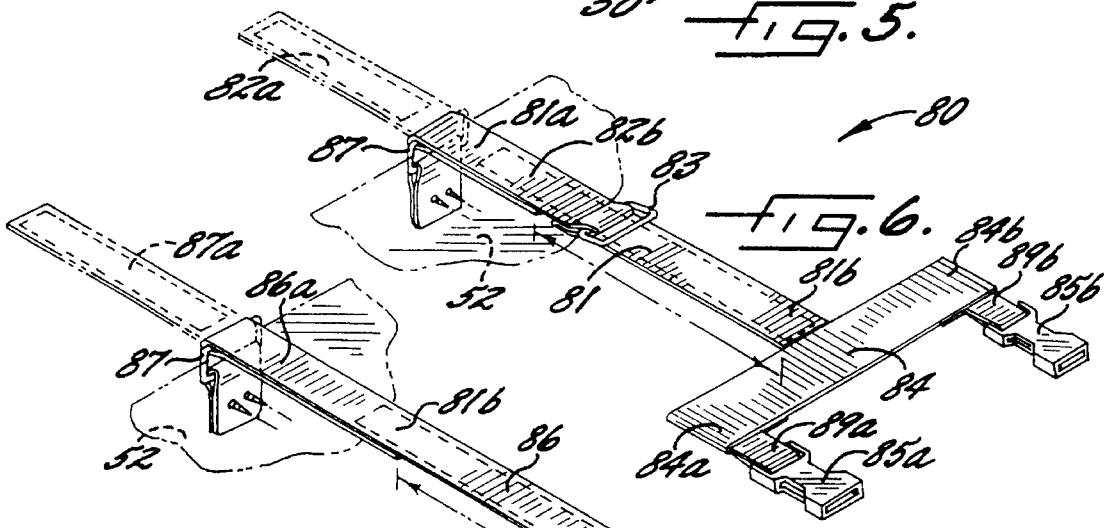
Fig. 6.
Fig. 7.
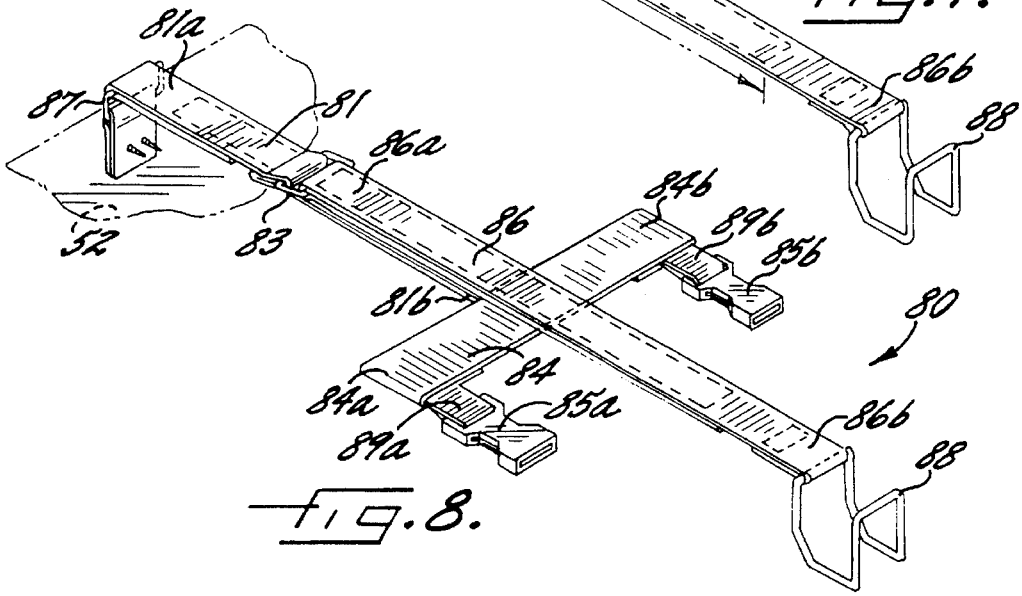
Fig. 8.

MODULAR WHEELED LUGGAGE SYSTEM, WHEELED LUGGAGE, GARMENT BAG AND CONNECTOR FOR SAME

FIELD OF THE INVENTION

This invention relates to luggage and more particularly to a wheeled luggage system for more conveniently carrying personal and business items during travel.

BACKGROUND OF THE INVENTION

Extensive travel often requires a traveller to handle their own luggage in walking through airports, hotels, or other various assembling and marshalling areas. The luggage is usually heavy when fully loaded and, therefore, a traveller often uses a dolly truck, bell-hop, or sky-cap to transport the luggage through these assembling and marshalling areas and to their destinations. These methods of transporting the luggage, however, are sometimes impractical, difficult, expensive, or burdensome to the traveller.

To solve this luggage transporting problem, wheels and retractable handles have been added to luggage to enable the traveller to easily transport the luggage through airports, hotels, and the like. Some examples of early types of wheeled luggage may be seen in U.S. Pat. No. 2,925,283 by Stilger entitled "Luggage On Wheels"; U.S. Pat. Re. No. 28,757 by Cassimally entitled "Trolley Case"; and U.S. Pat. Re. No. 29,036 by Hager entitled "Luggage Transport Structure." Some types of wheeled luggage, such as seen in U.S. Pat. No. 4,087,102 by Sprague entitled "Hand Carryable Travel Container Convertable To Rollable Cart" and U.S. Pat. No. 4,314,624 by Royet entitled "Wheel-Mounted Luggage", have added retractable wheels to enhance the portability of the luggage. Others have attempted to strengthen the pulling or handle mechanism as seen in U.S. Pat. No. 5,048,649 by Carpenter et al. entitled "Luggage With Pull Handle." Still others have applied the wheels and handle directly to garment bags to improve their portability as seen in U.S. Pat. No. 4,406,353 by Walker entitled "Wheeled Garment Bag" and U.S. Pat. No. 4,538,709 by Williams et al. entitled "Wheeled Garment Bag."

Some of the recent popularity of wheeled luggage has developed from the increased popularity of airline travel. A frequent problem that particularly occurs in airline travel, however, is that the Federal Aviation Administration ("FAA"), for example, has guidelines that only allow a passenger to bring two carry-on bags into a passenger compartment of an airplane when boarding. A traveller, however, often would like to have multiple pieces of luggage, including pieces such as wheeled luggage for traveling through airports, a garment bag for suits or dresses, a briefcase, a portable computer, or additional luggage which does not require checking, loading, and transporting the luggage by the airline itself. Also, the traveller often is faced with the decision of packing more belongings, i.e., clothing, files, etc., than they can physically carry versus making sure they have all the belongings that may be needed sure inclement weather, business situations, or the like arise during travel. If three or more pieces of luggage are needed, the traveller must check at least one of the pieces with the airline. This requirement of checking luggage with the airline itself may slow eventual departure from the airport as the traveller waits to disembark from the passenger compartment and also waits for the luggage to be unloaded by airline personnel, may cause the traveller to be late for or miss scheduled meetings, and entrusts the luggage with a third party, i.e., airline personnel, which entails risk of damage or lost items.

Additionally, the two pieces of luggage that the traveller chooses to carry into the passenger compartment must be sized to fit either beneath the passenger's seat or in the overhead storage area above the passenger's seat on the airplane. If the luggage pieces are too large or if the traveller wants to pack additional items in the luggage, he once again must check luggage through the airline. Further, the traveller may also experience problems with transporting the additional luggage through various marshalling areas and the like.

OBJECTS AND SUMMARY OF THE INVENTION

It is an object of the present invention to provide a modular wheeled luggage system that is relatively lightweight for travel and sized so that the two major luggage components thereof fit either beneath the seat or in an overhead storage area above a passenger's seat in a passenger compartment of an airplane.

It is also an object of the present invention to provide a modular wheeled luggage system that allows an airline passenger to transform three or more pieces of luggage into two pieces of appropriately-sized luggage as carry-on luggage for airline travel.

More particularly, a modular wheeled luggage system according to the present invention preferably has major components thereof particularly arranged and sized to be positioned either underneath or in the overhead storage area above a passenger's seat in a passenger compartment of an airplane. A first major component of the luggage system preferably is a first piece of luggage having overall respective length, width, and depth dimensions of no greater than 24-inches by 16-inches by 10-inches. The first piece of luggage includes a body portion, wheels connected to rearward lower end portions of the body portion, and a luggage connector detachably connected to the body portion for detachably connecting additional luggage to forward portions thereof. A second major component preferably includes second and third pieces of luggage connected together and sized to have overall respective length, width, and depth dimensions no greater than 24-inches by 16-inches by 10-inches. The second piece of luggage preferably is detachably connected to the luggage connector of the first piece of luggage, positioned adjacent and overlying forward portions of the body portion of the first piece of luggage, and sized so that the second piece of luggage approximates the circumferential size of the body portion of the first piece of luggage. The third piece of luggage preferably is connected to the second piece of luggage and sized so that the luggage case has a circumferential size of substantially no greater than either the second piece of luggage or the body portion of the first piece of luggage. The third piece of luggage preferably is connected to the second piece of luggage so that when the second piece of luggage is disconnected from the luggage connector of the first piece of luggage the third piece of luggage remains connected to the second piece.

According to the present invention, the first piece of luggage of a modular wheeled luggage system preferably is wheeled luggage that has a body portion, wheels connected to rearward lower end portions of the body portion, a retractable handle upwardly extendable from rearward upper portions of the body portion, and a luggage connector connected to the body portion for detachably connecting additional luggage to forward portions thereof. The second piece of luggage of the luggage system preferably is a foldable garment bag detachably connected to the luggage connector of the wheeled luggage, positioned adjacent and overlying forward portions of the body portion of the wheeled luggage, and sized so that when in a folded position the folded garment bag compactly approximates the circumferential size of the body portion of the wheeled luggage. The third piece of luggage is preferably a luggage case, such as a briefcase, a laptop computer case, or a suitcase, sized so that the luggage case has a circumferential size of no greater than either the folded garment bag or the body portion of the wheeled luggage. The luggage case preferably is detachably connected to the foldable garment bag so that when the garment bag is disconnected from the luggage connector of the wheeled luggage the luggage case remains connected to the foldable garment bag and readily may be positioned in an overhead storage area or underneath a passenger's seat in an airplane's passenger compartment.

Also, the first piece of luggage, i.e., wheeled luggage, according to another embodiment further includes a retractable handle extendable upwardly from upper portions of the body portion and means connected to the upper portions of the body portion and the handle for respectively extending and retracting the handle upwardly from and downwardly toward the body portion of the wheeled luggage. The extending and retracting means preferably includes at least a piston chamber and a piston operable within the piston chamber. Preferably the extending and retracting means has a pressurized cylinder having the piston chamber positioned within inner portions thereof. The pressurized cylinder and piston are connected to the body portion and the handle of the wheeled luggage. The pressurized cylinder preferably biases the piston in an extended position absent an external force applied thereto. The extending and retracting means preferably further includes locking means connected to the body portion and engaging the piston for responsively locking the handle in a predetermined position.

A foldable garment bag is also provided according to the present invention. The foldable garment bag has a pair of main longitudinally extending panels formed of a fabric material. The main fabric panels are longitudinally connected along a main common fold line and are arranged to receive clothing therein. A first matingly connecting means is connected to each of the main fabric panels for matingly connecting the pair of main fabric panels upon folding along the main common fold line. At least one of the main fabric panels includes a medial fabric panel and first and second side fabric panels respectively connected along a pair of common transverse fold lines extending the width of the main fabric panel so that each of the side fabric panels foldably overlie the medial fabric panel. Second matingly connecting means are connected to outer portions of at least one of the fabric panels. A pair of fabric flaps are secured to portions of the same fabric panel and arranged to receive a luggage case therein. The pair of fabric flaps and the second matingly connecting means are arranged to detachably connect a luggage case to portions of the foldable garment bag when in a folded position. A pair of fold protectors preferably are connected to an inner surface of at least one of the main fabric panels and extend the substantial length of the pair of common transverse fold lines which extend the width of the main fabric panel. The pair of fold protectors preferably extend above the inner surface and are positioned to overlie a corresponding pair of transverse fold lines of the other one of the main fabric panels.

A luggage connector of the present invention preferably includes a first elongate strap having a first end portion arranged to detachably connect to a first piece of luggage and extend longitudinally and outwardly therefrom. A second elongate strap is connected along medial portions thereof to a second end portion of the first elongate strap and extends transversely and outwardly therefrom. The second elongate strap has a pair of connectors secured thereto and arranged to detachably connect a second piece of luggage positioned adjacent forward portions of the first piece of luggage. A third elongate strap has a first end portion detachably connected to medial portions of the first elongate strap and longitudinally extends outwardly therefrom so as to overlie a second piece of luggage. The third elongate strap has a connector secured to a second end portion thereof and arranged to connect to a third piece of luggage positioned closely adjacent forward portions of a second piece of luggage.

A method of connecting and positioning luggage for airline travel is also included according to the present invention. The method preferably includes connecting a first piece of luggage to a second piece of luggage. The first and second pieces of luggage together are sized to fit either underneath a passenger's seat or in an overhead storage area in a passenger compartment of an airplane. The second piece of luggage then is detachably connected to forward portions of the third piece of luggage. The third piece of luggage is also sized to fit either underneath a passenger's seat or in an overhead storage area in a passenger compartment of an airplane.

BRIEF DESCRIPTION OF THE DRAWINGS

Some of the features and advantages of the present invention having been stated, others will become apparent as the description proceeds when taken in conjunction with the accompanying drawings, in which:

FIG. 5 illustrates an environmental view of a first embodiment of wheeled luggage of a modular wheeled luggage system according to the present invention being positioned underneath an airline traveller's seat by an airline traveller shown in phantom lines;

FIG. 6 illustrates a perspective view of a first embodiment of a luggage connector of a modular wheeled luggage system according to the present invention;

FIG. 7 illustrates a perspective view of a second embodiment of a luggage connector of a modular wheeled luggage system according to the present invention;

FIG. 8 illustrates a perspective view of a third embodiment of a luggage connector of a modular wheeled luggage system according to the present invention;

DETAILED DESCRIPTION

The present invention now will be described more fully hereinafter with reference to the accompanying drawings in which typical preferred embodiments of the invention are shown. This invention may, however, be embodied in many different forms and should not be construed as limited to the illustrated embodiments set forth herein; rather these embodiments are provided so that this disclosure will be thorough and complete and will fully convey the scope of the invention to those skilled in the art. Like numbers refer to like elements throughout.

FIGS. 1–10 illustrate a modular wheeled luggage system 40 according to a first embodiment the present invention. As best illustrated in FIGS. 1–3 and 5, the modular wheeled luggage system 40 preferably is sized so that two major luggage components of the system 40 readily fit either in the storage area underneath a passenger's seat UA or in the overhead storage area above the passenger's seat OA as illustrated by the positioning of these luggage components by a stewardess S and a traveller T. The two major luggage components preferably are also relatively lightweight and portable for ease of use by a frequent traveller.

Figure 1:
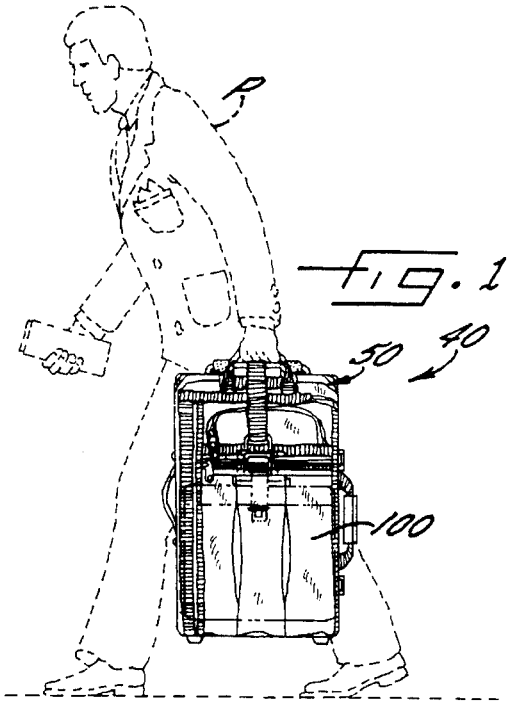
FIG. 1 illustrates an environmental view of a modular wheeled luggage system according to the present invention being carried by an airplane pilot shown in phantom lines.
Figure 2:
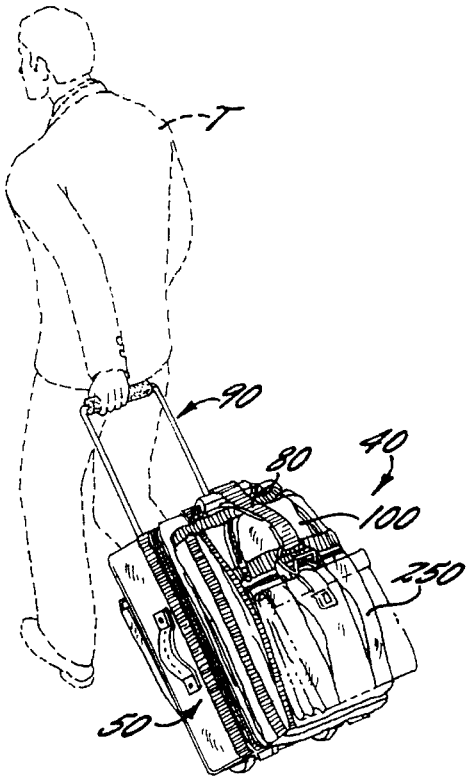
FIG. 2 illustrates an environmental view of a modular wheeled luggage system according to the present invention being pulled with the extended retractable handle by a airline traveller shown in phantom lines.
Figure 3:
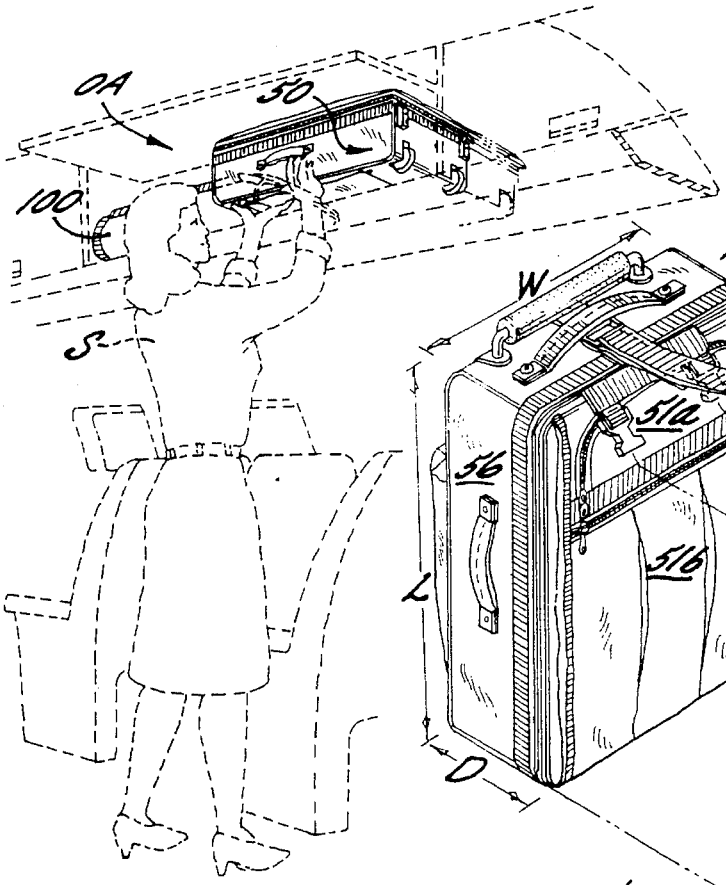
FIG. 3 illustrates an environmental view of a modular wheeled luggage system according to the present invention being positioned into an overhead storage area of an airplane by a stewardess shown in phantom lines.
Figure 4:
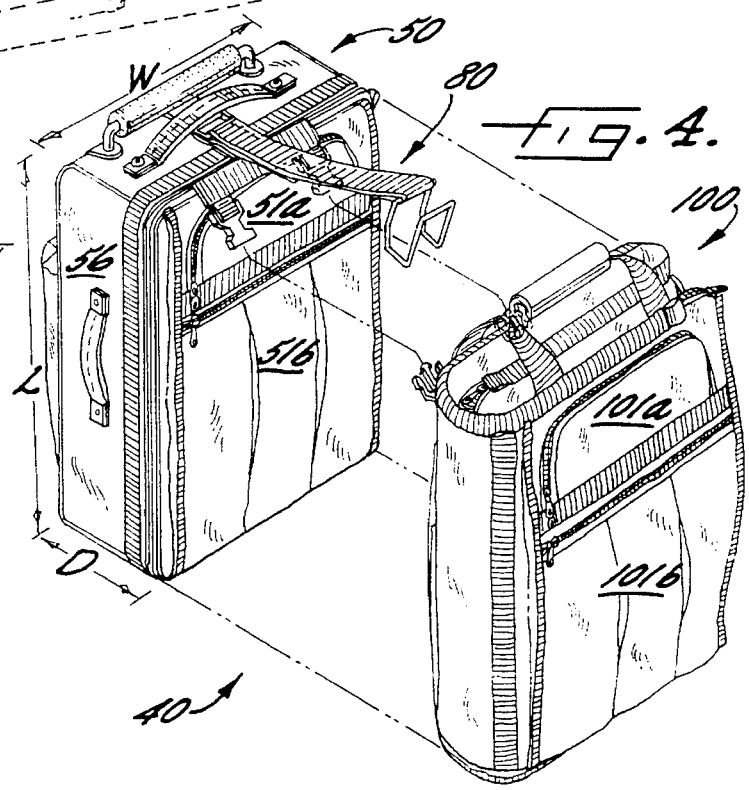
FIG. 4 illustrates an exploded perspective view of a first embodiment of wheeled luggage and a first embodiment of foldable garment bag of a modular wheeled luggage system according to the present invention.
Figure 9:
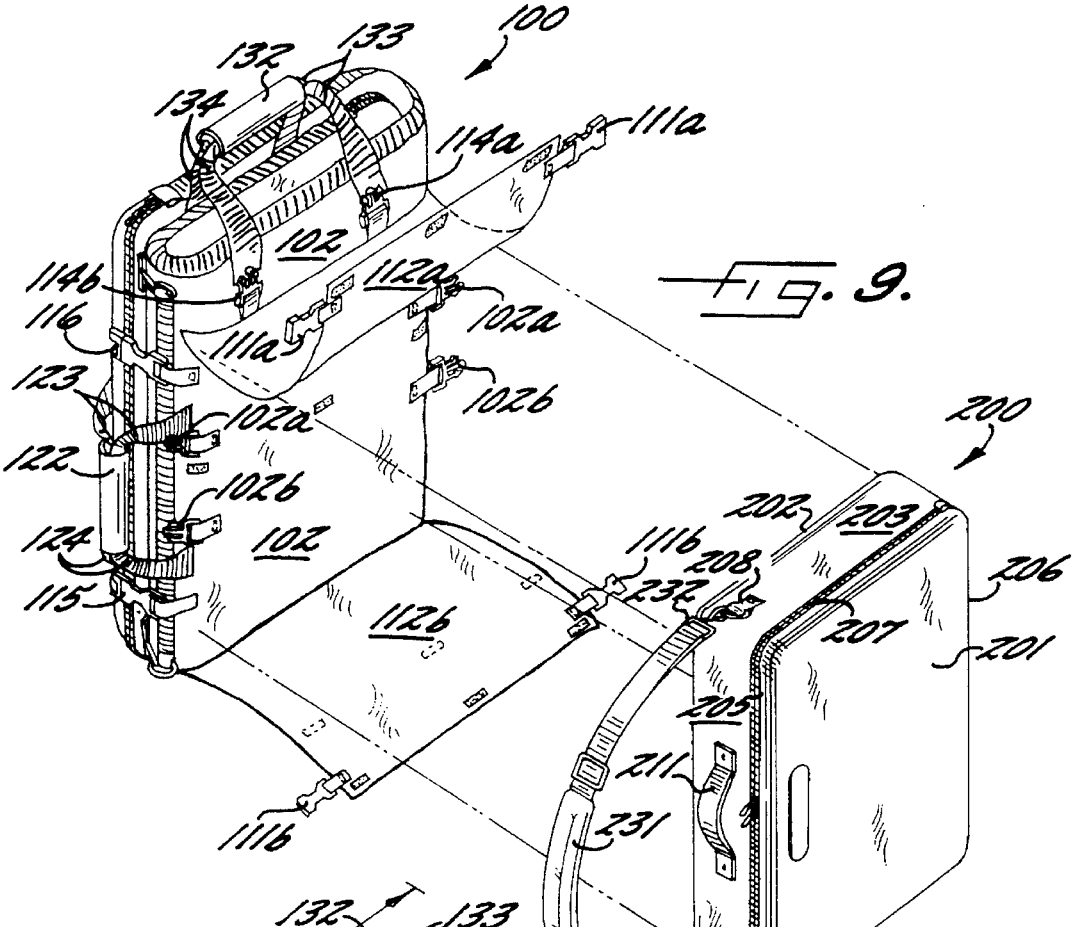
FIG. 9 illustrates an exploded perspective view of a first embodiment of a foldable garment bag and a first embodiment of a luggage case of a modular luggage system according to the present invention.
Figure 10:
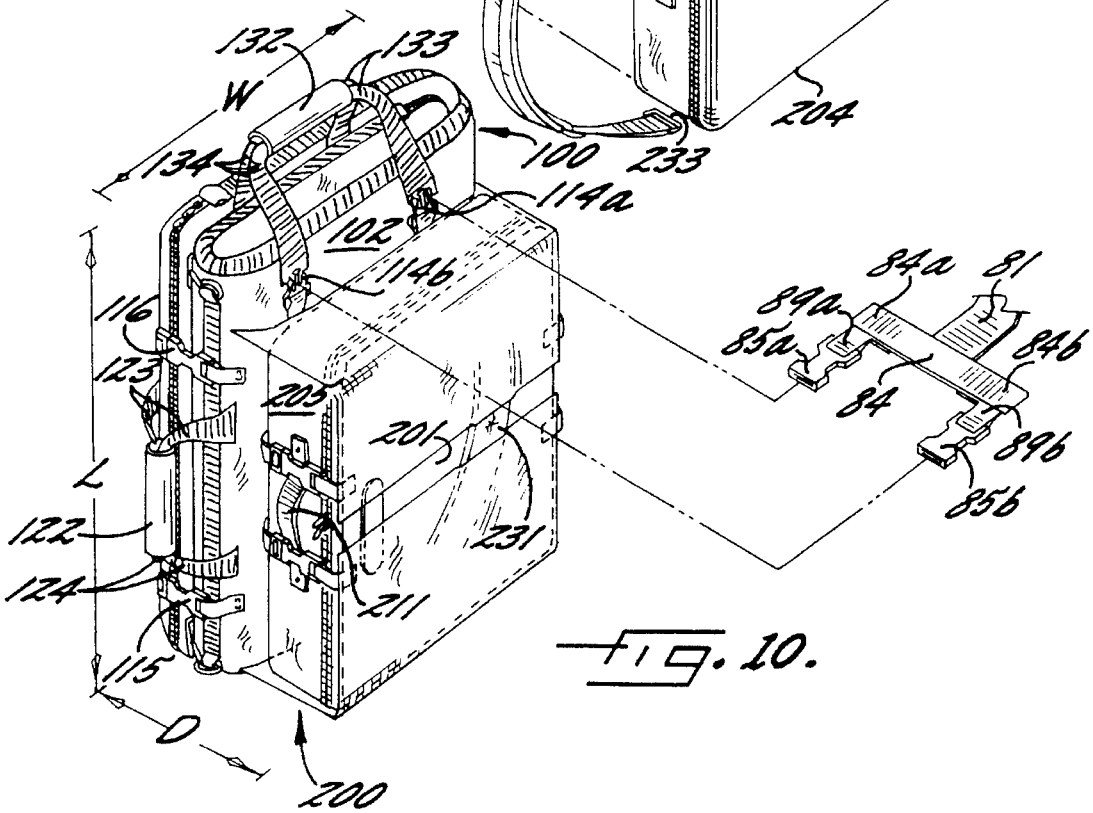
FIG. 10 illustrates a perspective view of a first embodiment of a foldable garment bag and a first embodiment of a luggage case detachably connected thereto of a modular luggage system according to the present invention.
Figure 11:
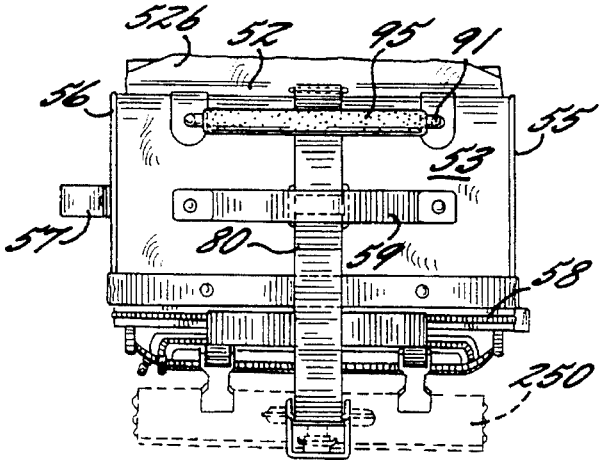
FIG. 11 illustrates a top plan view of a first embodiment of wheeled luggage and a luggage connector of a modular wheeled luggage system according to the present invention and having a briefcase connected thereto shown in phantom lines.
Figure 12:
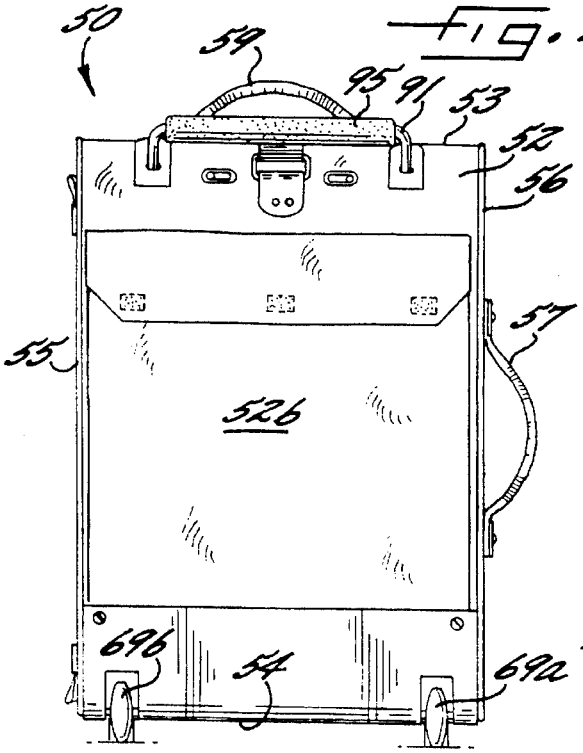
FIG. 12 illustrates a rear elevational view of a first embodiment of wheeled luggage of a modular wheeled luggage system according to the present invention.
Figure 30:
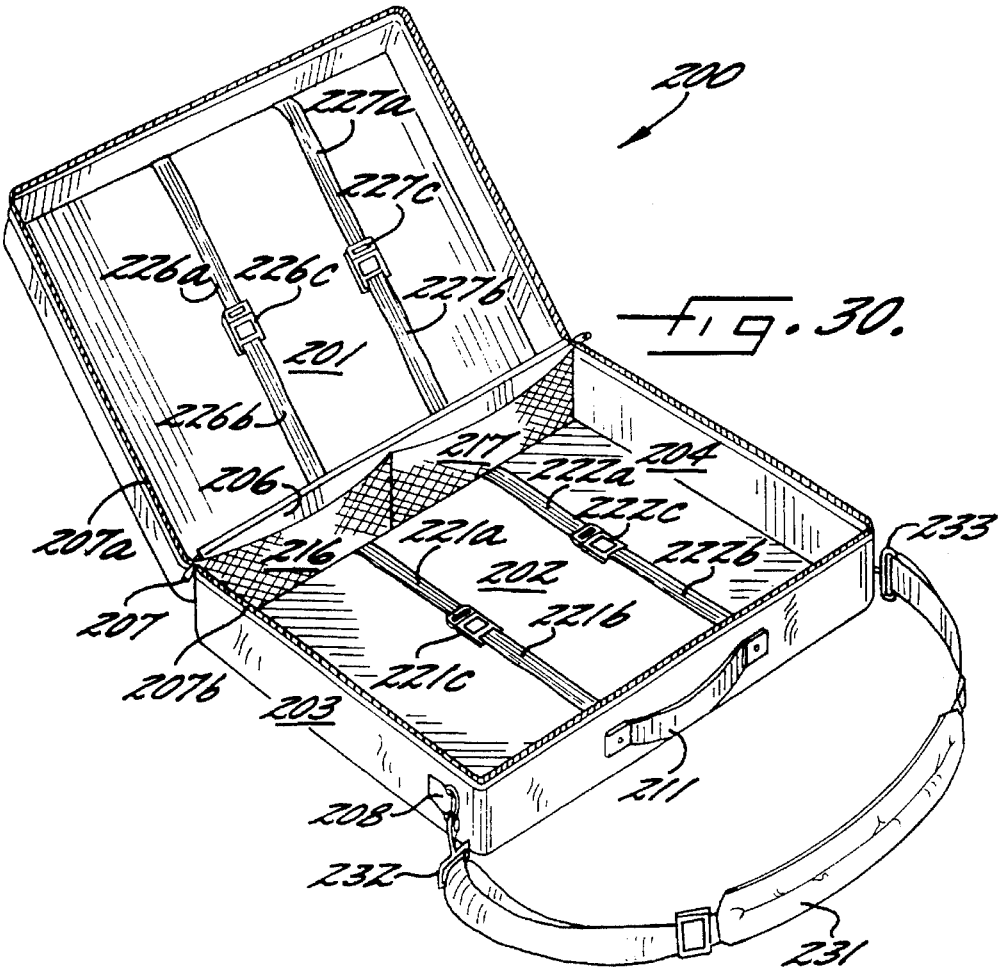
FIG. 30 illustrates a perspective view of a fourth embodiment of a luggage case of a modular wheeled luggage system according to the present invention being in an opened position.
Figure 31:
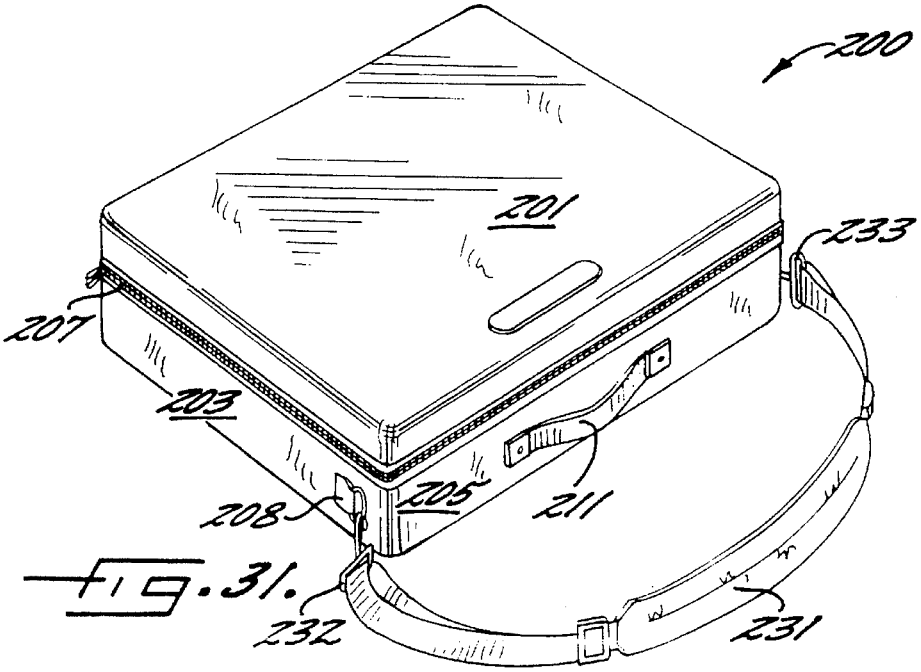
FIG. 31 illustrates a perspective view of a fourth embodiment of a luggage case according to the present invention being in a closed position.

The first major luggage component of the modular wheeled luggage system 40 preferably is wheeled luggage 50 which forms a first piece, i.e., base, of luggage for transporting the luggage system 40 through airports, hotels, or other various assembling and marshalling areas as illustrated by a pilot P and the traveller T in the respective environmental views of FIGS. 1 and 2. As illustrated in FIG. 4, the wheeled luggage 50 preferably has overall dimensions of a length of about 24-inches or less, a width of about 16 inches or less, and a depth of about 10 inches or less to readily fit within the underneath storage area UA or the overhead storage area OA such as presently required by the Federal Aviation Administration ("FAA") guidelines or regulations, other state, national or international guidelines or regulations, the particular guidelines or regulations for individual commercial airlines, or other regulatory authority guidelines or regulations. The second major luggage component, as best illustrated in FIGS. 4 and 9–10, is a combination of a foldable garment bag 100 (FIGS. 9–10), i.e., second piece of luggage, and a luggage case 200 (FIGS. 30–31), i.e., third piece of luggage, connected to the foldable garment bag 100. The luggage case 200 preferably is detachably connected to the foldable garment bag 100 by a pair of encasing flaps 112*a*, 112*b* formed of fabric and a plurality of mating connectors 102*a*, 102*b*, 111*a*, 111*b* (FIGS. 9–10) and may be embodied in several forms such as illustrated by the luggage cases 200, 300, 400, 500 in FIGS. 24–31. The combination of the garment bag 100 and the luggage case 200 is then preferably connected by a pair of connectors 114*a*, 114*b* secured to the garment bag 100 to portions, i.e., forward, side, of the wheeled luggage 50 by connecting means illustrated in the form of a luggage connector 80 (FIGS. 6–8) detachably connected to an upper body portion of the wheeled luggage 50. As best illustrated in FIG. 10, the combination of the foldable garment bag 100 and the luggage case 200 likewise preferably has overall dimensions of a length of about 24-inches or less, a width of about 16 inches or less, and a depth of about 10 inches or less to readily fit within the underneath storage area UA or the overhead storage area OA such as required by the Federal Aviation Administration ("FAA") guidelines or the particular guidelines or regulations for the individual commercial airlines.

FIGS. 2, 4 and 11–17 include various views of a first embodiment of the wheeled luggage 50 illustrating the outward appearance and construction thereof according to a first embodiment of a modular wheeled luggage system 40 of the present invention. The wheeled luggage 50 preferably includes a body portion formed by a frame 60 and a covering 70. A pair of wheels 69*a*, 69*b* are connected to lower end portions of the body portion. A retractable handle 90 preferably is extendable upwardly from rearward portions of the body portion. FIG. 2 illustrates the wheeled luggage 50 being pulled by an extended retractable handle 90 connected to the upper portion of the body portion thereof. FIG. 4 illustrates a perspective view of a modular wheeled luggage system 40 and includes the wheeled luggage 50 with the retractable handle 90 in a retracted position.

Figure 15:
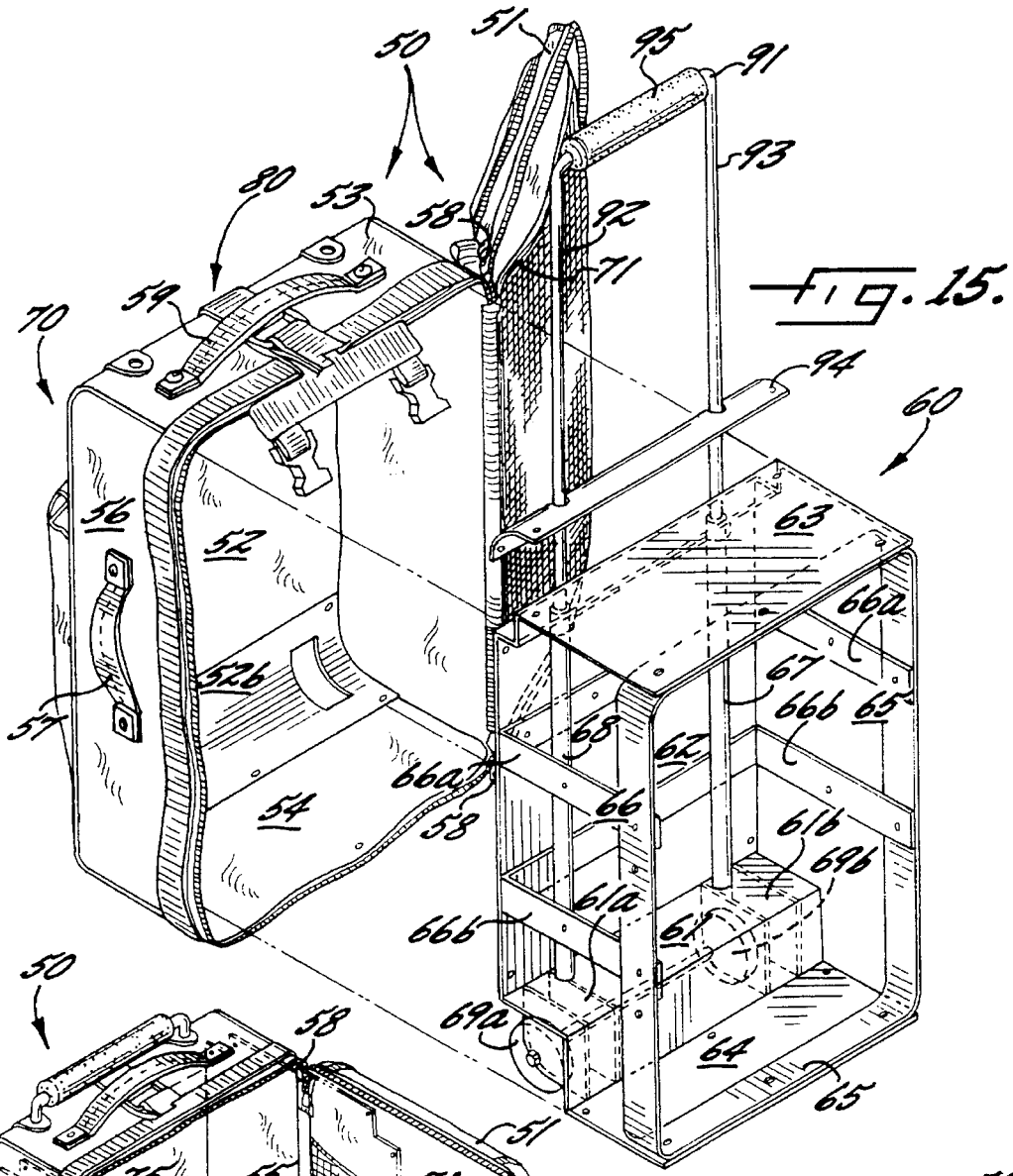
FIG. 15 illustrates an exploded perspective view of interior portions of a first embodiment of wheeled luggage of a modular wheeled luggage system according to the present invention.
Figure 16:
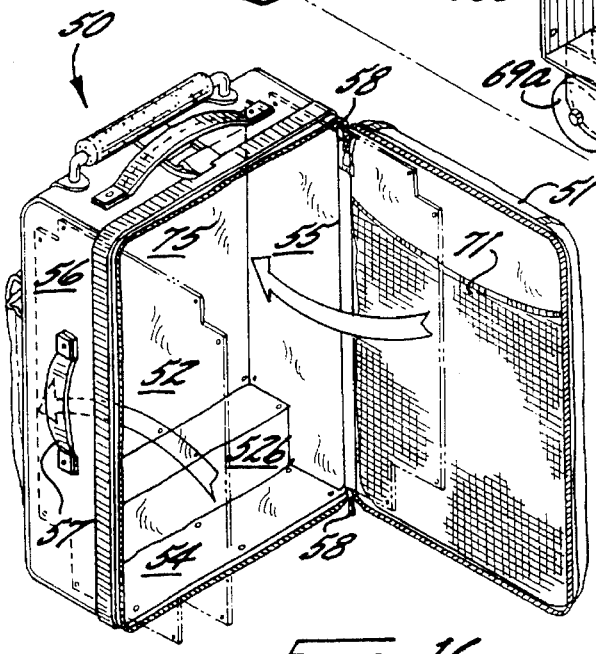
FIG. 16 illustrates a perspective view of interior portions of a first embodiment of wheeled luggage of a modular wheeled luggage system according to the present invention.
Figure 17:
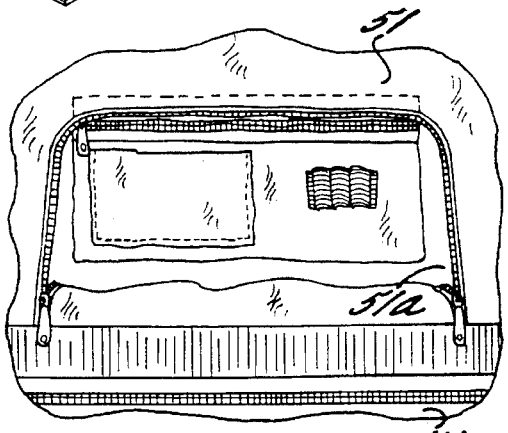
FIG. 17 illustrates a fragmentary view of interior portions of an upper front pocket of wheeled luggage of a modular wheeled luggage system according to the present invention.

The structural frame 60 of the wheeled luggage 50 has a pair of spaced-apart upper and lower frame plate members 63, 64. The lower frame also includes a wheel support member 61 positioned between and connected to the lower frame plate member 64 and a rear frame plate member 62. The rear frame plate member 62 is also connected to rearward ends of the upper frame member 63 (FIG. 15). A front peripheral frame member 65 connects to front end portions of the upper and lower frame member 63, 64 to provide additional structural strength and support. A pair of spaced-apart rib frame members 66*a*, 66*b* are connected to and extend generally perpendicular between the front peripheral frame member 65 and the rear frame member 62 as illustrated.

A pair of spaced-apart and longitudinally extending tubular frame members 67, 68 also extend between the upper frame member 63 and the wheel support member 61 and preferably are positioned closely adjacent the rear frame plate member 62 within the confines of the body portion as illustrated. A pair of corresponding parallel side members 92, 93 of the retractable handle 90 are telescopically received by the pair of tubular frame members 67, 68 and in conjunction with a cross member 91 form a retractable generally U-shaped handle 90. The U-shaped handle 90 has a padded cover 95 connected to and surrounding the cross member 91, and when extended the handle 90 latches into a locked position preferably as illustrated in U.S. Pat. No. 5,295,565 by Latshaw, a common inventor of the present invention, which is hereby incorporated herein in its entirety by reference. The parallel side members 92, 93 of the retractable handle 90 preferably have notches therein adjacent the lower ends thereof for cooperating with the latching means and for locking the handle 90 in an extended position.

Pairs of spaced apart wheel mounting members 61*a*, 61*b* extend downwardly from and are connected to rear portions of the lower wheel support member 61. The lower ends of the lower frame member 64 preferably are positioned in a common plane with the lower portions of the wheels 69*a*, 69*b* so that the wheeled luggage 50 may be positioned in and rest in an upright position.

The covering 70 of the wheeled luggage 50 preferably is formed of a fabric material and encloses portions of the frame 60 to form a body cavity 75 as illustrated. The covering 70 forms a substantially rectangular enclosure and includes exteriorly accessible pockets 51*a*, 51*b*, 52*b*, extending along the front and back of the enclosure. The covering 70 also has zippers and other fasteners associated with the pockets 51*a*, 51*b*, 52*b* for controlling access thereto. Protective tabs preferably overlie ends of the zippers for protectively shielding the zippers from damage and inadvertent opening thereof. The covering 70 has upper and lower end walls 53, 54, a pair of side walls 55, 56, and front and back walls 51, 52 respectively spaced apart and interconnected as illustrated. The covering 70 also has a mesh pocket 71 connected to a front wall member 51 thereof. The mesh pocket 71 provides ease of access and breathability for items stored therein.

An upper hand engageable lifting member 59 preferably formed of pliable fabric connects to the upper end wall 53 of the covering 70 and the upper frame plate member 63 of the frame 60 to facilitate manual lifting of the wheeled luggage 50 and the luggage system 40. A side hand engageable lifting member 57 also formed of pliable fabric connects to the side wall 56 of the covering 70 and the frame 60 at a side thereof, i.e., rib members 66*a*, 66*b* for facilitating the manual lifting of the luggage from a different position than the upper hand member 59. An openable fastener means in the form of a zipper 58 on the covering 70 provides access to the interior of the body cavity. Like the pockets 51*a*, 51*b*, 52*b*, protective tabs overlie ends of the zipper 58 for protectively shielding the zipper 58 from damage and inadvertent openings.

FIGS. 6–8 further illustrate the construction and operation of the luggage connector 80 of the modular wheeled luggage system 40 of the present invention. The luggage connector 80 has a first elongate strap 81 formed of a pliable material detachably connected by first end portions 81*a* of the upper rearward portion of the wheeled luggage 50. The first end portion 81*a* preferably has mating VELCRO™-type fasteners 82*a*, 82*b* connected thereto so that the first end portion 81*a* inserts through a loop or ring retaining member 87 secured to the rear wall 52, 62 of the wheeled luggage 50. The mating VELCRO™-type fasteners preferably comprise the plurality of hooks and the plurality of loops known to those skilled in the art for readily adjusting, connecting, and disconnecting the straps of the luggage connector 80. It will also be understood by those skilled in the art that various other fasteners may also be used according to the present invention. The first elongate strap 81 longitudinally extends forwardly and outwardly so as to overlie upper and front portions of the wheeled luggage 50. As best illustrated in FIG. 6, a second elongate strap 84 preferably is connected along medial portions thereof to a second end portion 81*b* of the first elongate strap 81 and extends transversely and outwardly therefrom. The second elongate strap 84 has a pair of mating connectors 85*a*, 85*b* respectively secured to a pair of extension straps 89*a*, 89*b* which, in turn, are secured to first and second end portions 84*a*, 84*b* of the second elongate strap 84. The pair of mating connectors 85*a*, 85*b* matingly receive the pair of connectors 114*a*, 114*b* secured to upper rear portions of the foldable garment bag 100 (FIG. 10).

As best illustrated in FIGS. 2, 7–8, and 13, the luggage connector 80 also preferably includes a third elongate strap 86 having a first end portion 86*a* arranged to be detachably connected either to the retaining ring member 87 secured to the rear wall 52, 62 of the wheeled luggage 50 or to a retaining ring member 83 secured to medial portions of the first elongate strap 81. The first end portion 86*a* preferably is detachably secured to the retaining ring member 83 by VELCRO™-type fasteners secured to the first end portion 86*a* of the third elongate strap 86.

Figure 13:
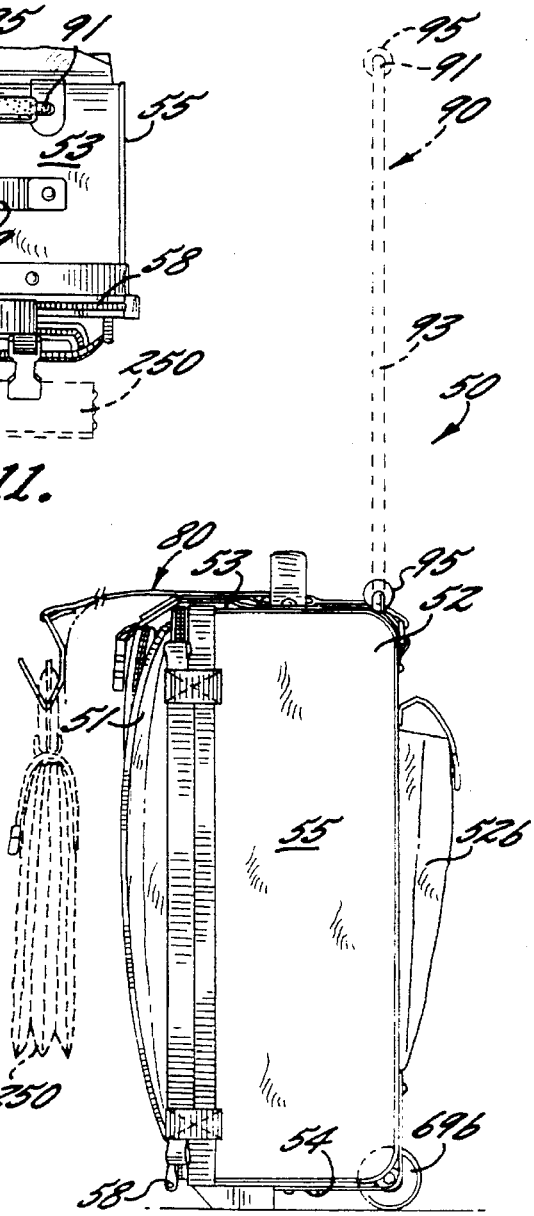
FIG. 13 illustrates a side elevational view of a first embodiment of wheeled luggage and a luggage connector of a modular wheeled luggage system according to the present invention and having a briefcase connected thereto shown in phantom lines.
Figure 14:
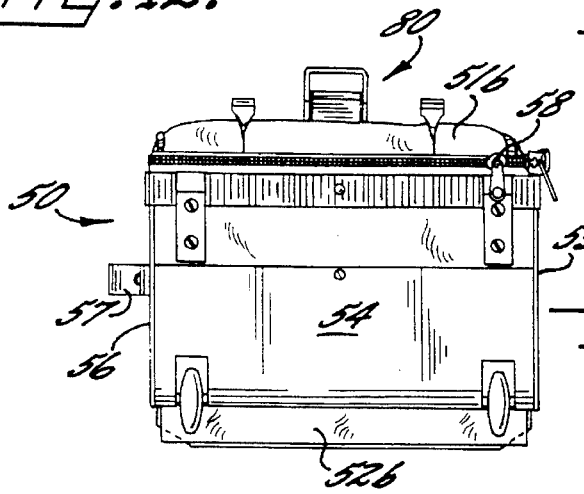
FIG. 14 illustrates a bottom plan view of a first embodiment of wheeled luggage of a modular wheeled luggage system according to the present invention.

FIG. 13 best illustrates a side elevational view of the wheeled luggage 50 having the retractable handle 90 extended in phantom lines and a briefcase 250, also in phantom lines (also see FIG. 2), attached to an auxiliary carrier means broadly designated at 88 of the wheeled luggage. The auxiliary carrier means 88 is provided for positioning, connecting, and/or carrying the briefcase 250 or the like exteriorly of either the wheeled luggage 50 or the foldable garment bag 100. The auxiliary carrier means 88 is shown in the form of a rigid U-shaped wire frame connector or carrier secured to a second end portion 86*b* of the third elongate strap 86 of the luggage connector 80 which overlies upper and upper front portions of the wheeled luggage 50 and/or the foldable garment bag 100. The luggage connector 80 of the present invention provides adjustable strap and/or connector positions for the luggage system 40. This allows the system 40 to be advantageously used without additional pieces of luggage or with three or more pieces of luggage.

FIGS. 9–10 and 18–23 further illustrate the construction and operation of a foldable garment bag 100 of the modular wheeled luggage system 40 according to the present invention. The foldable garment bag 100 preferably is a tri-fold type of garment bag and includes a pair of main longitudinally extending panels 161, 162 formed of a fabric. Although the invention is described as a tri-fold type of garment bag it will be understood by those skilled in the art that particularly constructed bi-fold or other types of garment bags may be used as well. The main fabric panels 161, 162 of the foldable garment bag 100 are longitudinally connected along a main common fold line 169. Each of the main fabric panels 161, 162 have respectively mating connectors 159, i.e., zippers, arranged to connect to the other one of the corresponding main fabric panels 161, 162 upon folding along the main common fold line 169. The main panels 161, 162 preferably have a plurality of pockets 171–174, a plurality of retaining straps and connectors 177–179, and at least one hanger 175 secured to inner surfaces thereof and arranged to receive clothing therein.

At least one of the main fabric panels, as illustrated by the main panel 162, of the foldable garment bag 100 includes a medial fabric panel 162*a* and first and second side fabric panels 162*b*, 162*c* respectively connected along a pair of common transverse fold lines 197, 198 extending the width of the main fabric panel 162 so that each of the side fabric panels 162*b*, 162*c* foldably overlie the medial fabric panel 162*a*. At least one of the fabric panels 162*a*, 162*b*, 162*c*, and preferably outer portions of the second side panel 162*b* in this first embodiment, have a pair of connectors 111*a*, 111*b* secured thereto and arranged to receive the luggage case 200 thereby detachably connecting the luggage case 200 to rear portions of the foldable garment bag 100 when in a folded position.

Figure 18:
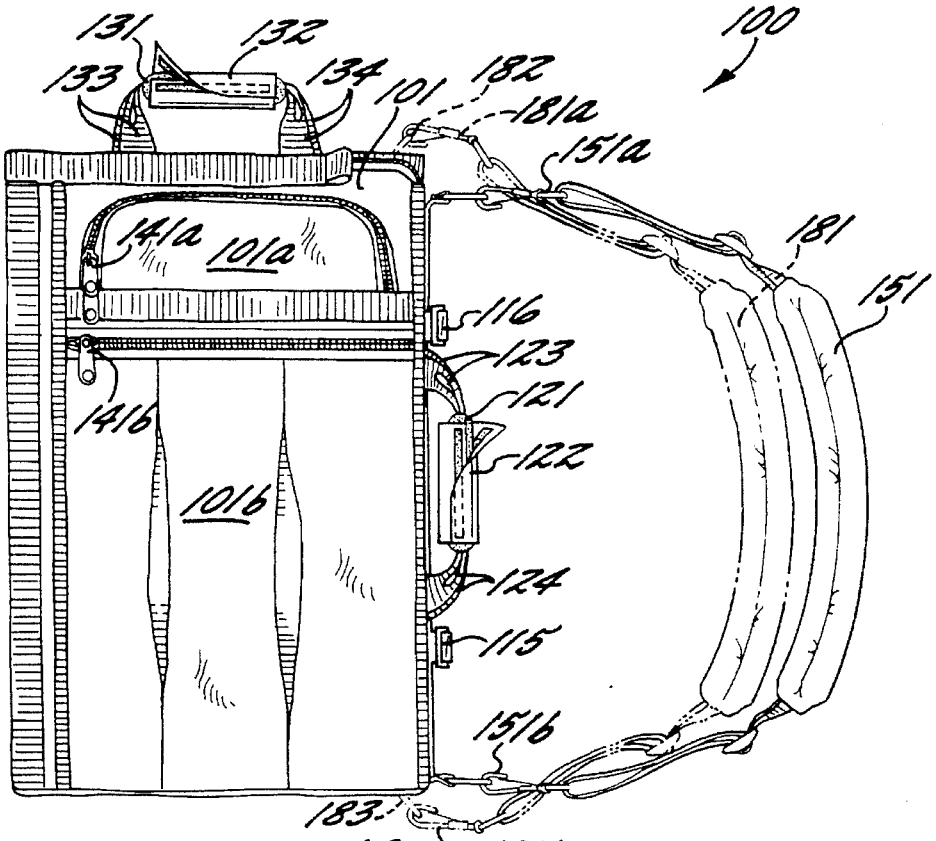
FIG. 18 illustrates a front elevational view of a first embodiment of a foldable garment bag according to the present invention.
Figure 19:
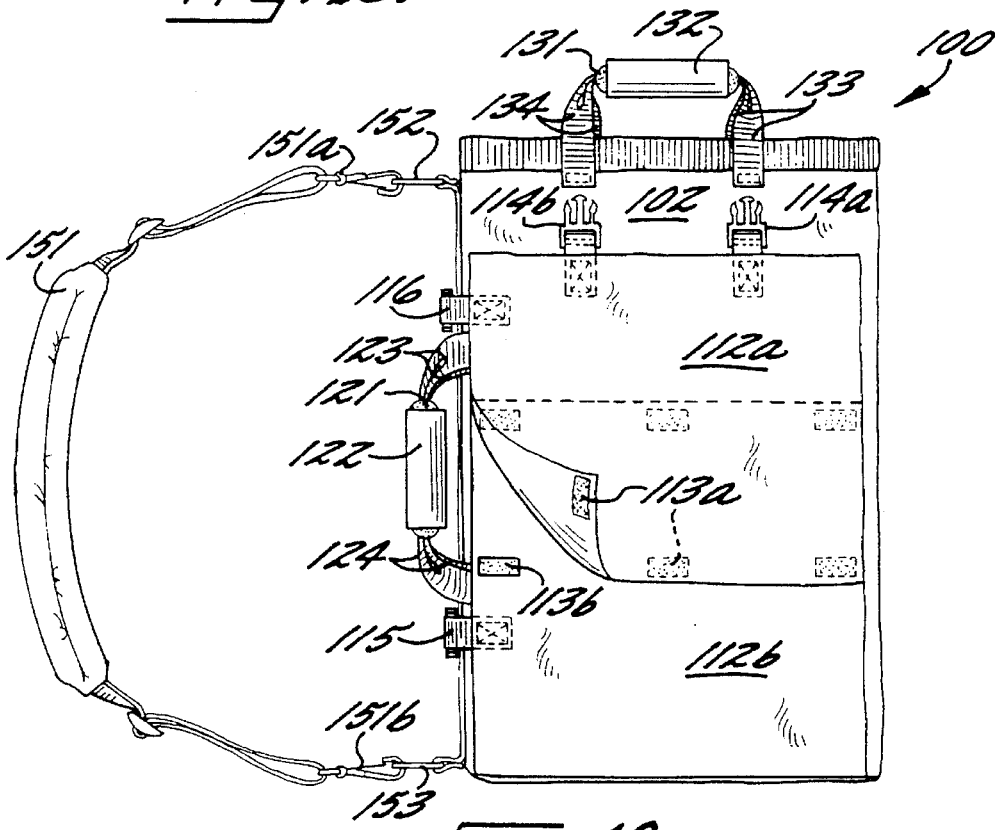
FIG. 19 illustrates a rear elevational view of a first embodiment of a foldable garment bag according to the present invention.
Figure 20:
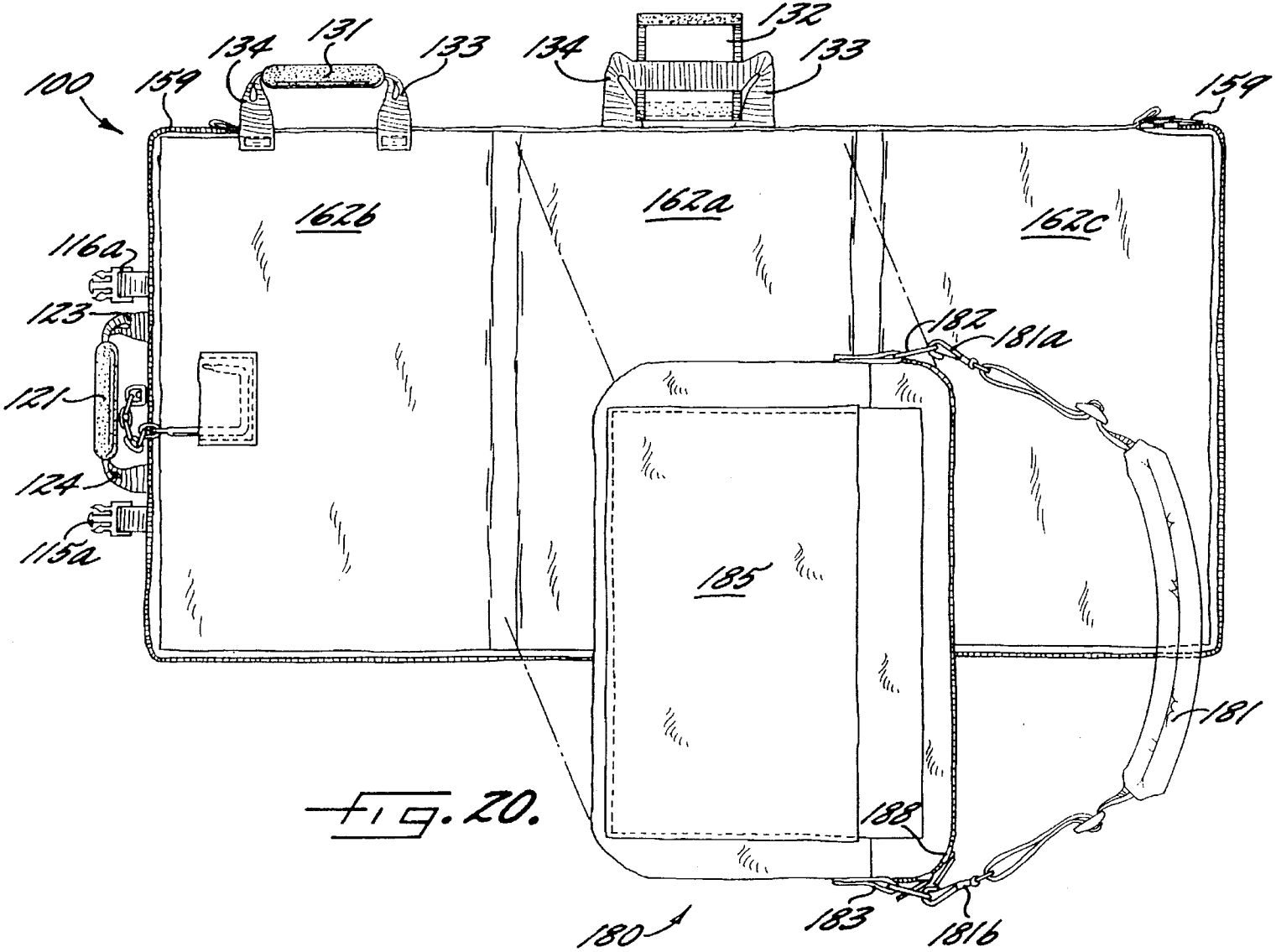
FIG. 20 illustrates an exploded rear elevational view of a partially folded garment bag having a carrying case of a modular wheeled luggage system according to the present invention.
Figure 21:
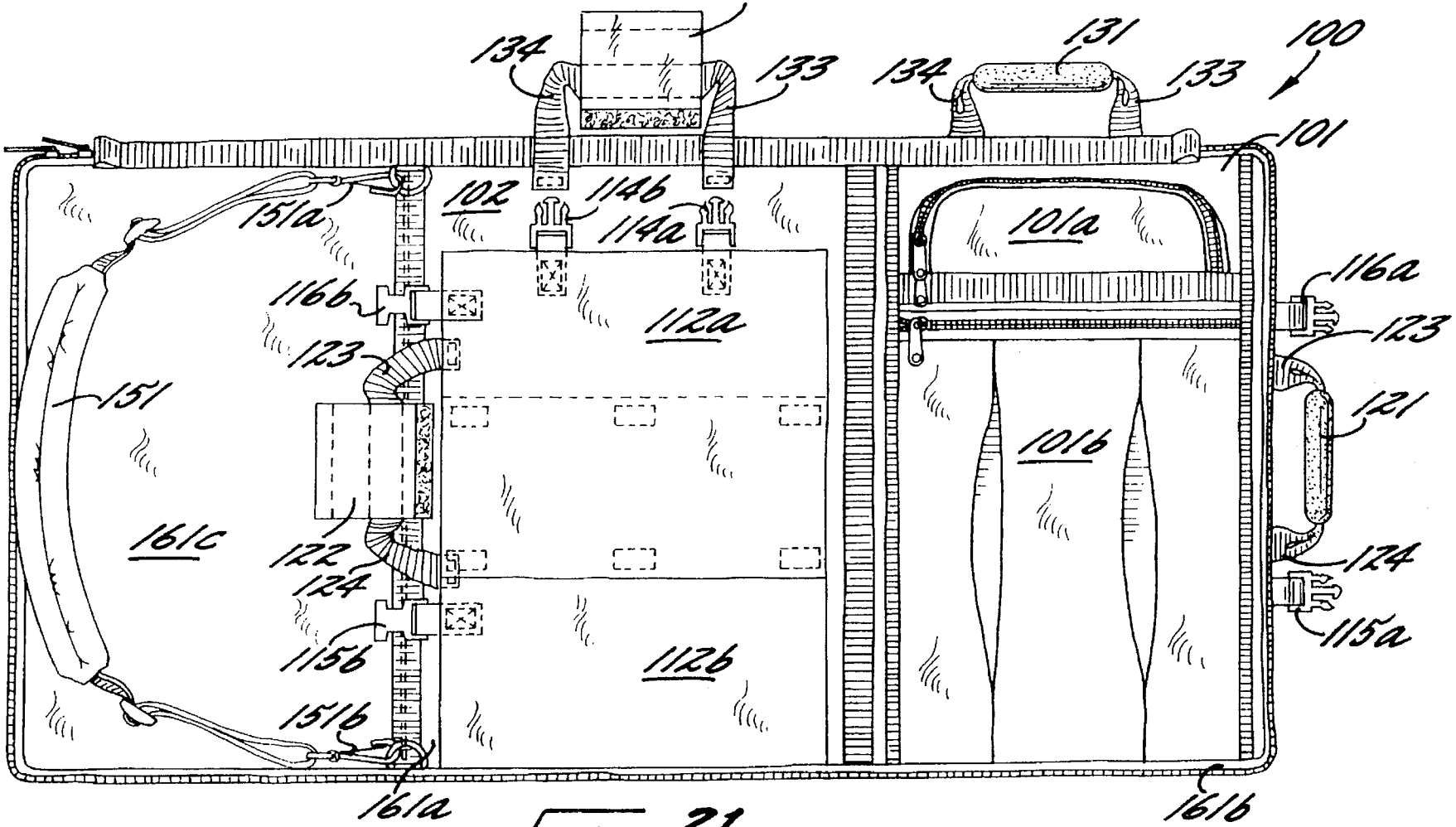
FIG. 21 illustrates a front elevational view of a first embodiment of a partially folded garment bag according to the present invention.

As best illustrated in FIGS. 18 and 20, the foldable garment bag 100 preferably further includes a carrying case 180, i.e., fourth piece of luggage, positioned to overlie at least one of the medial fabric panels 162*a* between the pair of common transverse fold lines 197, 198 when the main fabric panels 161, 162 are connected together. The carrying case 180 preferably has a main body portion 185 and a handle illustrated in the form of a carrying strap 181 detachably connected by respective first and second end connectors 181*a*, 181*b* to retaining ring members 182, 183 secured to upper portions of the main body portion 185. The carrying strap 181 of the carrying case 180 is arranged to support and carry the foldable garment bag 100 when in a folded position particularly when the side fabric panels 162*b*, 162*c* foldably overlie the carrying case 180.

Figure 22:
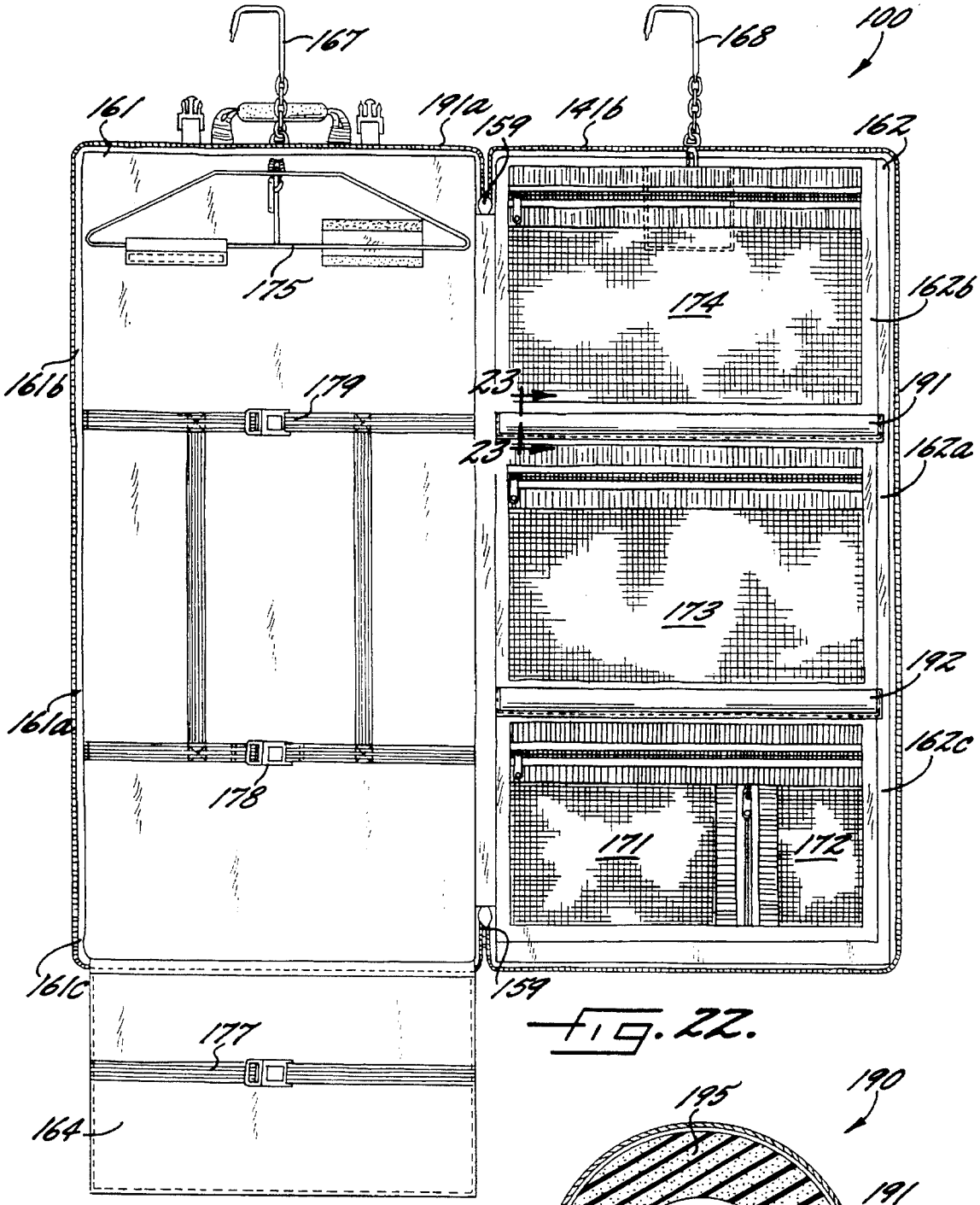
FIG. 22 illustrates an elevational view of a first embodiment of a foldable garment bag according to the present invention being in an opened position.
Figure 23:
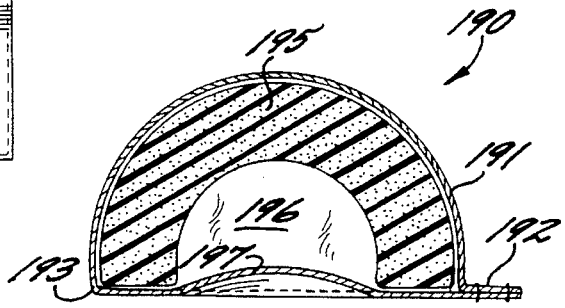
FIG. 23 illustrates a fold protector of a foldable garment bag of a modular wheeled luggage system according to the present invention taken along line 23—23 of FIG. 22.

As best illustrated in FIGS. 22 and 23, the foldable garment bag 100 further has a pair of fold protectors 190 connected or secured to an inner surface of at least one of the main fabric panels 162 and extending the substantial length of the pair of common transverse fold lines 197, 198 which extend the width of the main fabric panel 162. The pair of fold protectors 190 extend above the inner surface and are positioned to overlie corresponding common transverse fold lines of the other of the main fabric panels 161. The pair of fold protectors 190 preferably each have an elongate fabric compartment having an upstanding elongate foam member 195 positioned therein so that the fabric compartment extends above the inner surface of the main fabric panel 162. The upstanding elongate foam member 195 has a channel 196 longitudinally extending therethrough and positioned closely adjacent the inner surface of the main fabric panel 162 so that external folding pressure on outer portions of the main fabric panel 162 responsively only allows the fold to extend inwardly toward and within the confines of the foam member 195 and thereby protect the folding pressure from extending beyond the foam member 195 and to clothing, i.e, suits, dresses, or shirts hanging on the hanger 175 of the other main panel 161, retained within the confines of the garment bag.

FIGS. 24–31 illustrate four different embodiments of a luggage case 200, 300, 400, 500 according to the present invention. The first embodiment (FIGS. 30–31), as also illustrated in FIGS. 9 and 10, is in the form of a suitcase 200 having a generally rectangular shape and which includes upper and lower portions 201, 202 joined by a zipper 207 extending around a pair of side walls 203, 204 and a front wall 205 connected and extending therebetween. The suitcase 200 also preferably has a carrying strap 231 connected by first and second ends 232, 233 thereof to a pair of retaining rings 208, 209 (not shown) secured to the respective side walls 203, 204. A suitcase handle 211 such as illustrated preferably is also secured to the front wall 205. A plurality of elongate straps 221*a*, 221*b*, 222*a*, 222*b*, 226*a*, 226*b*, 227*a*, 227*b* having respective mating connectors 221*c*, 222*c*, 226*c*, 227*c* secured thereto are positioned within interior portions of the suitcase 200 and secured to the upper and lower portions 201, 202 thereof. As understood by those skilled in the art, the plurality of straps 221*a*, 221*b*, 222*a*, 222*b*, 226*a*, 226*b*, 227*a*, 227*b* retain clothing positioned within the confines of the suitcase 200. As illustrated, pockets 216, 217 and other compartments are preferably positioned within interior portions of the suitcase such as along a rear wall 206 connected to and extending between the side walls 203, 204. The suitcase 200 compactly adapts to the modular wheeled luggage system 40 of the present invention and provides additional storage of clothing during travel and the like such as when a traveller purchases additional clothing at a destination or needs additional storage space for an extended stay at a destination.

Figure 24:
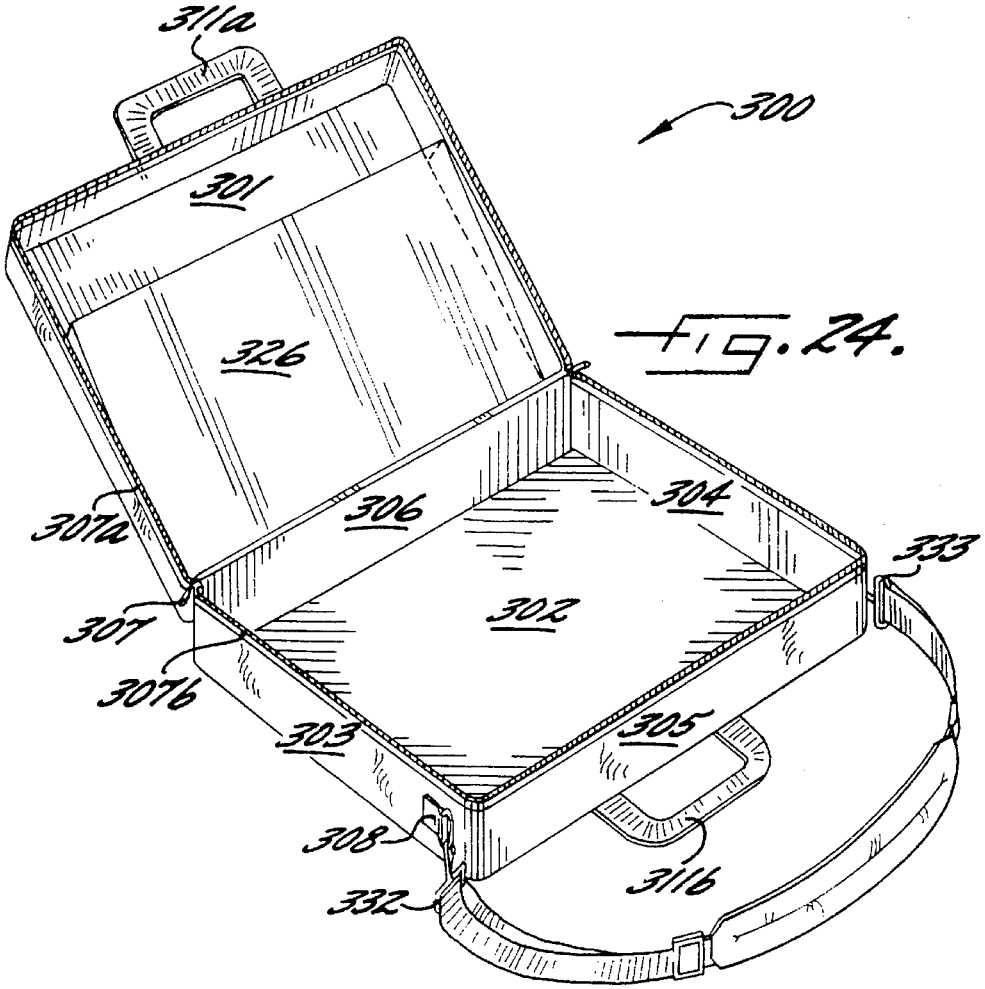
FIG. 24 illustrates a perspective view of a first embodiment of a luggage case of a modular wheeled luggage system according to the present invention being in an opened position.
Figure 25:
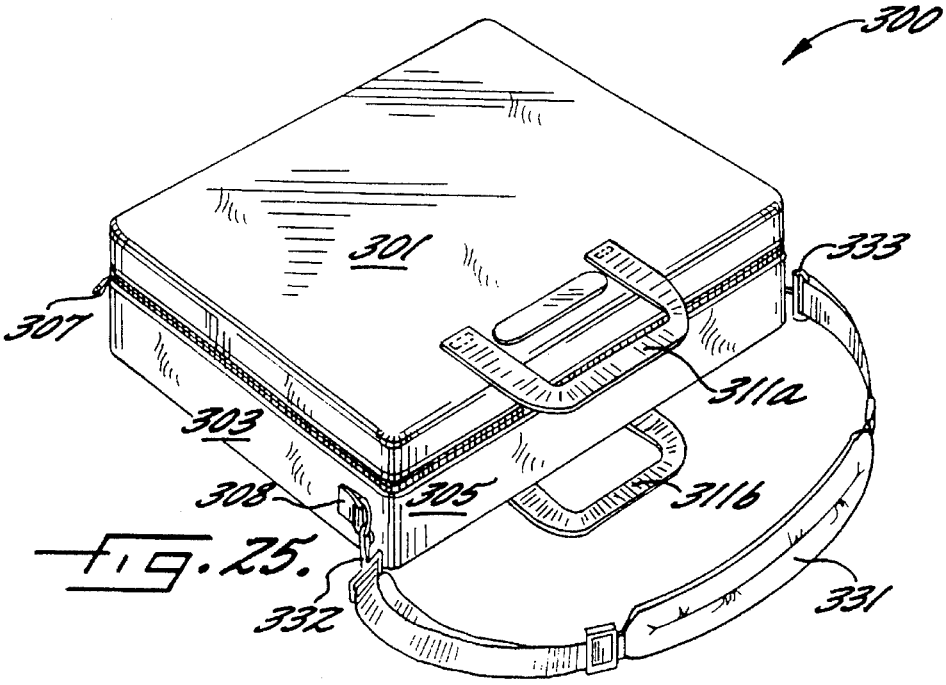
FIG. 25 illustrates a perspective view of a first embodiment of a luggage case according to the present invention being in a closed position.

FIGS. 24 and 25 illustrate a second embodiment of a luggage case according to the present invention shown in the form of a briefcase cover 300. The briefcase cover 300 preferably is sized and arranged to receive a traveller's briefcase therein to thereby compactly adapt the traveller's briefcase to the modular wheeled luggage system 40 of the present invention. The briefcase cover 300 also preferably has a generally rectangular shape and includes upper and lower portions 301, 302 joined by a zipper 307 extending around a pair of side walls 303, 304 and a front wall 305 connected and extending therebetween. The suitcase 200 also preferably has a carrying strap 331 connected by first and second ends 332, 333 thereof to a pair of retaining rings 308, 309 (not shown) secured to the respective side walls 303, 304. A pair of suitcase handles 311*a*, 311*b* is respectively secured to the upper and lower portions 301, 302 such as illustrated. The briefcase cover 300 preferably has a pocket 326 positioned along an inner surface of the upper portion 301 thereof to receive additional business papers or the like. As will be understood by those skilled in the art, various other types of briefcase shapes and covers may also be used according to the present invention.

Figure 26:
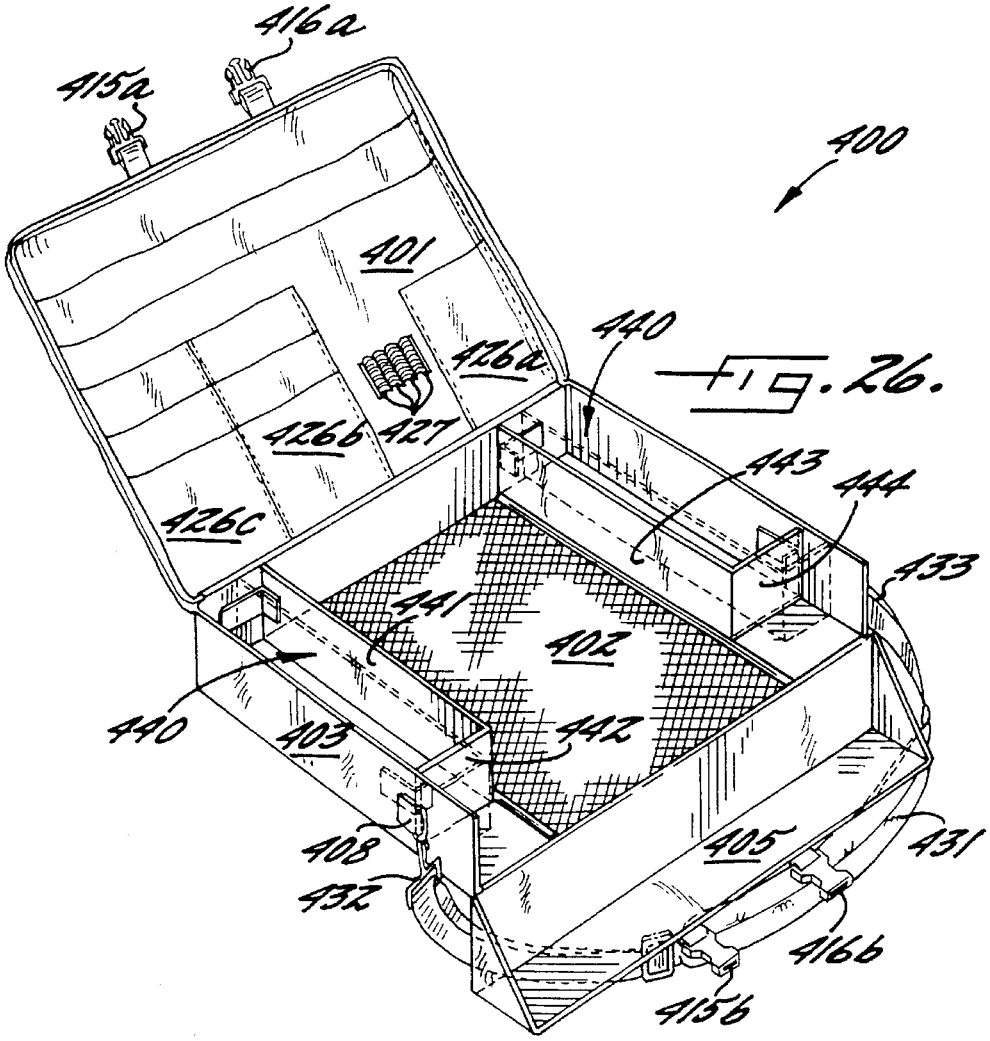
FIG. 26 illustrates a perspective view of a second embodiment of a luggage case of a modular wheeled luggage system according to the present invention being in an opened position.
Figure 27:
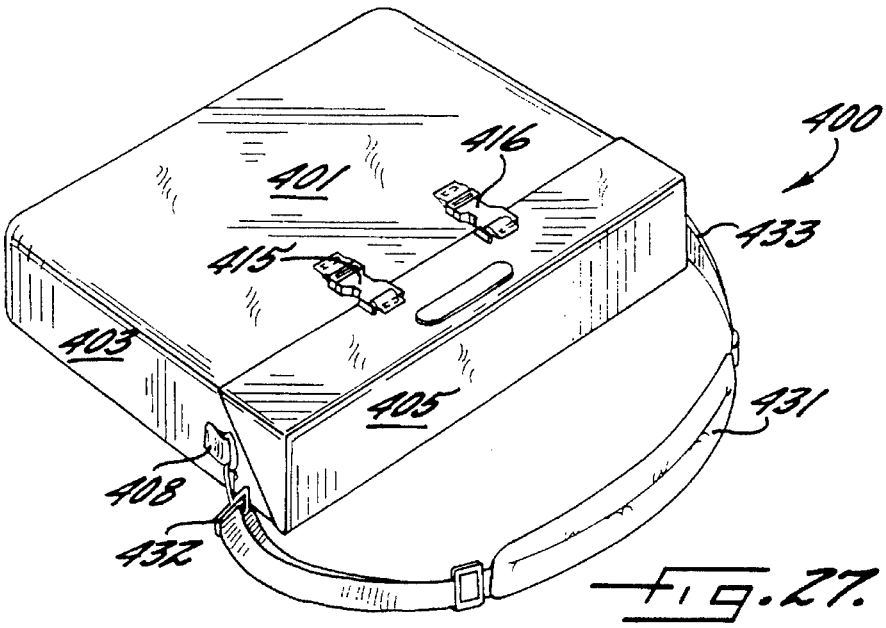
FIG. 27 illustrates a perspective view of a second embodiment of a luggage case according to the present invention being in a closed position.

FIGS. 26 and 27 illustrate a third embodiment of a luggage case according to the present invention shown in the form of a computer case 400. The computer case 400 is sized and arranged to receive a portable laptop computer therein to thereby compactly adapt the traveller's portable laptop computer to the modular wheeled luggage system 40 of the present invention. As illustrated, the computer case 400 preferably has a generally rectangular shape and has upper and lower wall portions 401, 402 joined at a front end thereof by a pivotally front cover member 405 and a pair of mating connectors 415*a*, 415*b*, 416*a*, 416*b* respectively secured to the upper wall portion 401 and the front cover member 405. A pair of spaced-apart side walls 403, 404, a rear wall 406 connected to and extending therebetween, and portions of the front cover member 405 form a cavity for retaining a laptop computer. Within the cavity, however, is also a pair of rectangular shaped storage compartments 440 respectively defined by a plurality of interconnected guide walls 441, 442, 443, 444. The storage compartments 440 adjustably retain the laptop computer in predetermined interior portions of the computer case 400 and provide storage for various items such as compact discs or the like. A plurality of pockets 426*a*, 426*b*, 426*c* and pencil/pen retainers 427 preferably are also secured to an inner surface of the upper wall portion 401 as illustrated.

Figure 28:
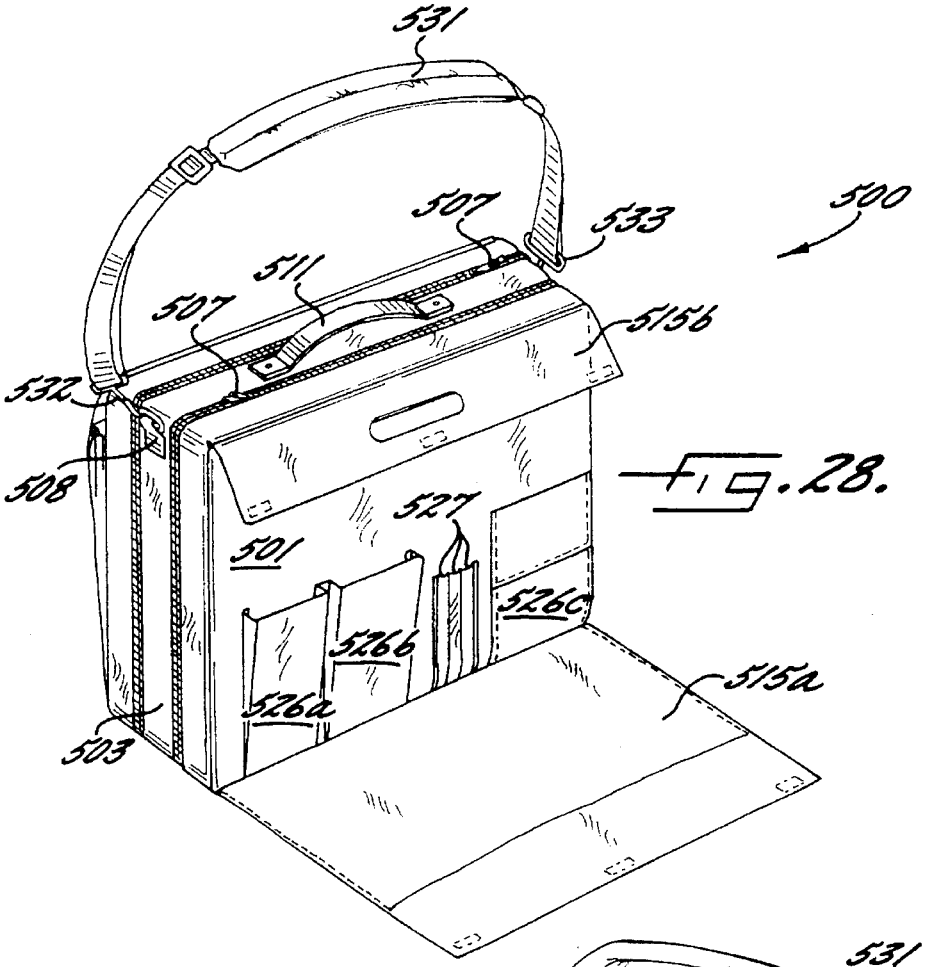
FIG. 28 illustrates a front perspective view of a third embodiment of a luggage case of a modular wheeled luggage system according to the present invention.
Figure 29:
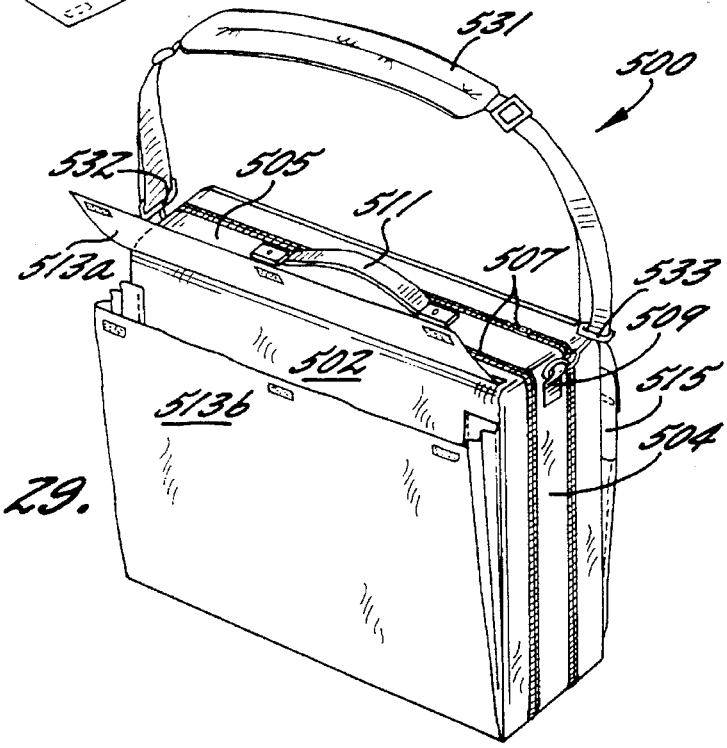
FIG. 29 illustrates a rear perspective view of a third embodiment of a luggage case according to the present invention.

FIGS. 28 and 29 illustrate a fourth embodiment of a luggage case according to the present invention shown in the form of a briefcase 500. The briefcase 500 is compactly adapted to the modular wheeled luggage system 40 of the present invention and conveniently provides various briefcase functions for a traveller T. Interior portions (not shown) of the briefcase 500 may have multiple configurations as understood by those skilled in the art, including individual or combinations of a general storage area for files, papers, and the like, as well as various pockets and retainers for pens/pencils. These interior portions are preferably formed of two separate compartments fastened by the openable fasteners illustrated in the form of zippers 507 extending around a pair of side walls 503, 504 and a front wall 505 connected to and extending therebetween.

Also as more particularly illustrated in the perspective views of FIGS. 28–29, the exterior portion of the briefcase 500 preferably includes a lower main pocket 513*a*, 513*b* secured to a lower wall 502 thereof and an upper main pocket 515*a*, 515*b* secured to an upper wall 501 thereof. Within the confines of the upper main pocket 515*a*, 515*b*, a plurality of pockets 526*a*, 526*b*, 526*c* and a pen/pencil retainer 527 are also preferably secured to the upper wall 501. A carrying strap 531 is also detachably connected to a pair of retaining rings 508, 509 respectively secured to the side walls 503, 504 by first and second end connectors 532, 533 thereof. A handle 511 is also preferably secured to the front wall 505 as illustrated to easily carry the briefcase 500 when not used in conjunction with the system 40 of the present invention.

Figure 32:
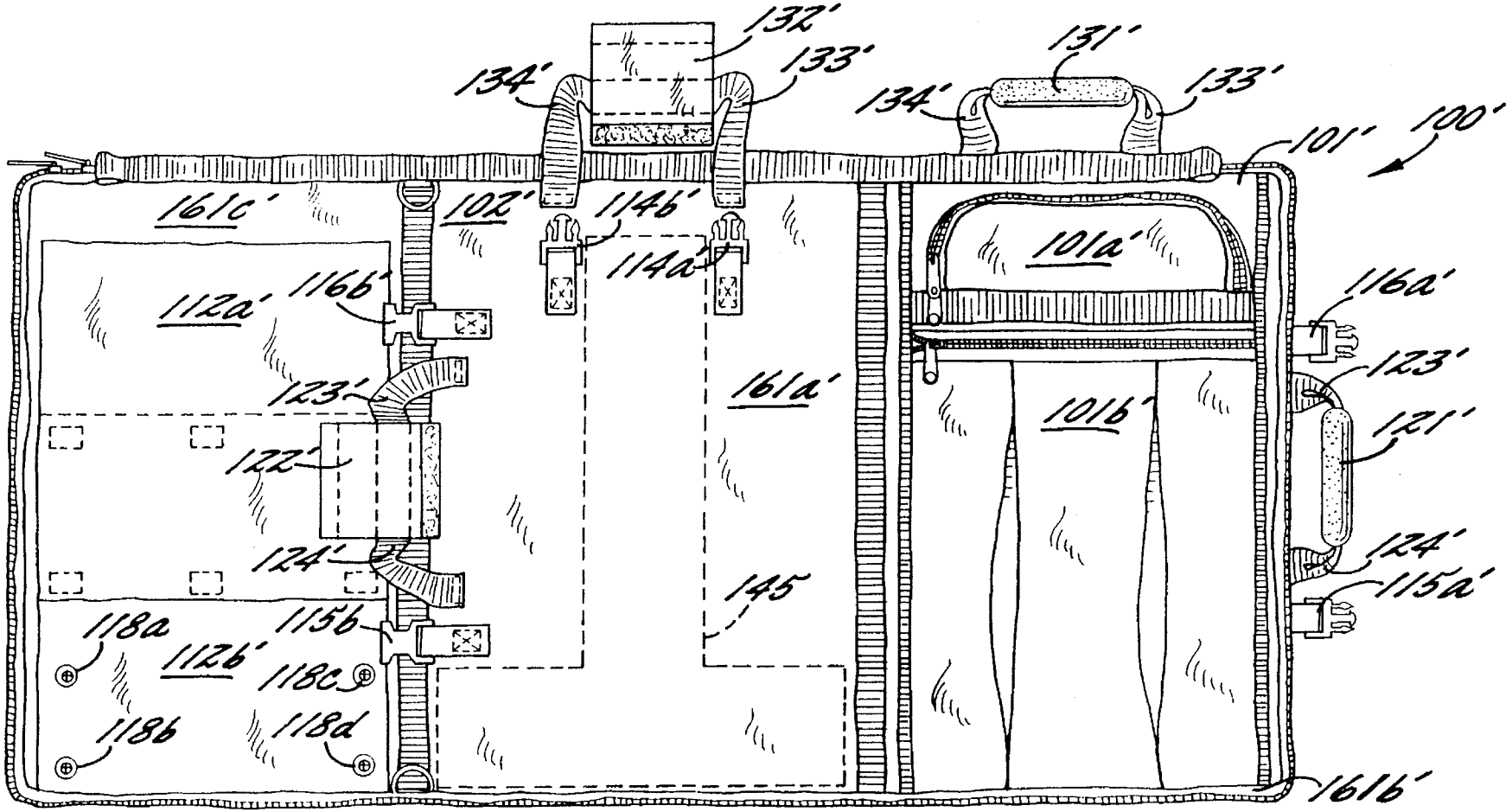
FIG. 32 illustrates a side elevational view of a second embodiment of a foldable garment bag according to the present invention being in a partially open position.
Figure 33:
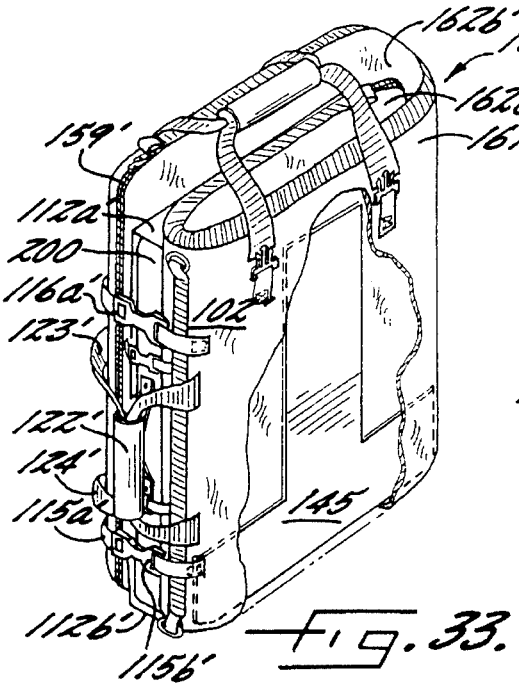
FIG. 33 illustrates a perspective view of a second embodiment of a foldable garment bag according to the present invention being in a folded position, having a luggage case connected thereto, and having outer portions thereof broken away.
Figure 34:
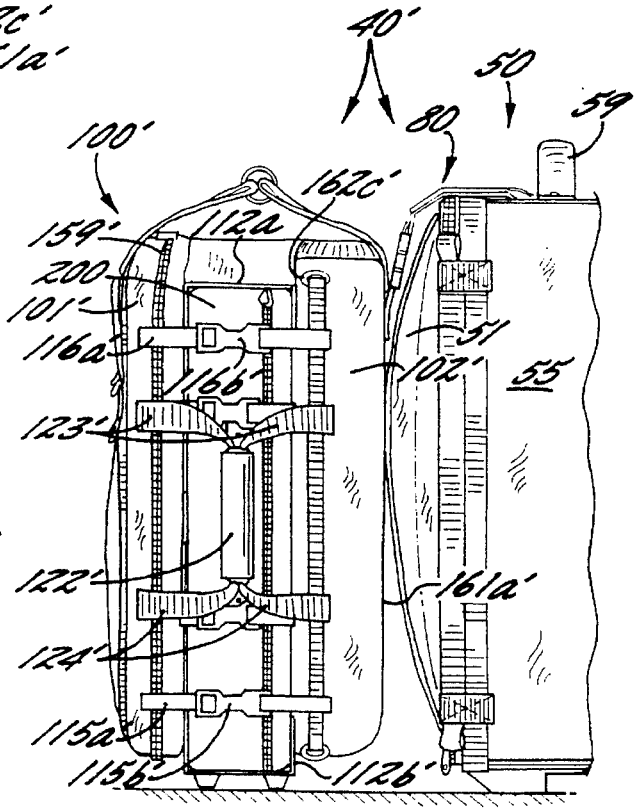
FIG. 34 illustrates a side elevational view of a second embodiment of a modular wheeled luggage system according to the present invention.

FIGS. 32–35 illustrate a second embodiment of a foldable garment bag 100' of a second embodiment of a modular luggage system 40' according to the present invention. Like numbers for various elements of the second embodiment of the foldable garment bag 100' are designated with prime (') notation. In this embodiment, the foldable garment bag 100' has a pair of encasing flaps 112*a*', 112*b*' connected to a side fabric panel 161*c*' thereof as best illustrated in FIG. 32. The lower encasing flap 112*b*' has feet connected thereto and illustrated in the form of a plurality of feet members 118*a*–118*d*. The encasing flaps 112*a*', 112*b*' in this embodiment are connected to the foldable garment bag 100' and positioned so that when the luggage case 200 is position therein the luggage case 200 extends downwardly a small distance below major portions of the foldable garment bag 100'. This position provides engagement of the feet members 118*a*–118*d* when the wheeled luggage 50 is in a rest position and provides protection for lower end portions of the second major component of the system 40' as best illustrated in FIG. 34.

As best illustrated in FIGS. 32–33, the second embodiment of the foldable garment bag 100' also has a frame member 145, shown as having a generally T-shape, connected to interior portions of one of the medial fabric panels 161*a*'. The frame member 145 is preferably connected to the medial fabric panel 161*a*' which is positioned closely to overlie forward portions of the wheeled luggage 50 to provide additional structural support when connected thereto.

Figure 35:
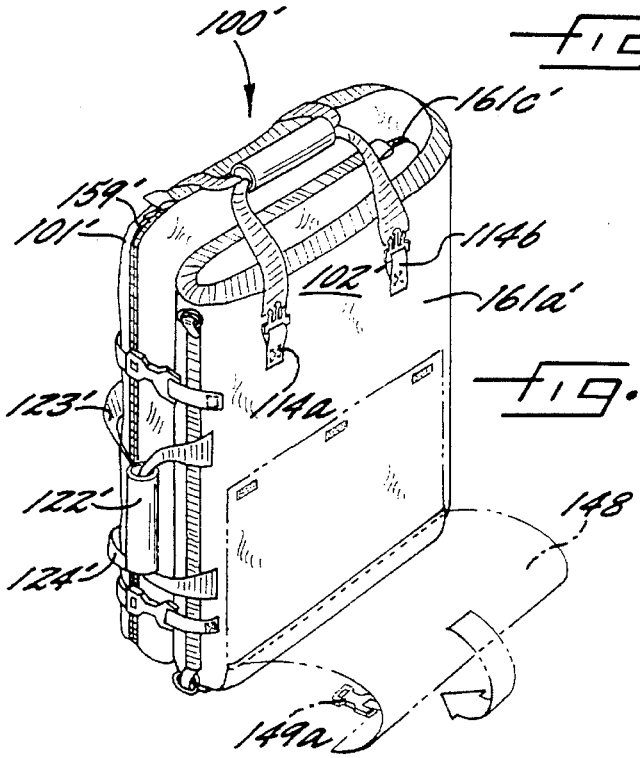
FIG. 35 illustrates a perspective view of a second embodiment of a foldable garment bag without a luggage case connected thereto according to the present invention.

Additionally, this same medial fabric panel 161*a*' preferably has a protective flap 148 formed of a leather fabric material or the like connected thereto. As best illustrated in FIG. 35, the protective flap 148 may be used by a traveller T, for example, when the luggage case 200 is not connected thereto to cover and protect lower end portions of the foldable garment bag 100'. Upper portions of the protective flap 148 have a pair of mating connectors 149*a*, 149*b* secured thereto which detachably disconnect from the medial panel 161*a'* and detachably connect to forward portions 101' of the folded garment bag 100', i.e., one of the side panels 161*b'*, as illustrated.

Figure 36:
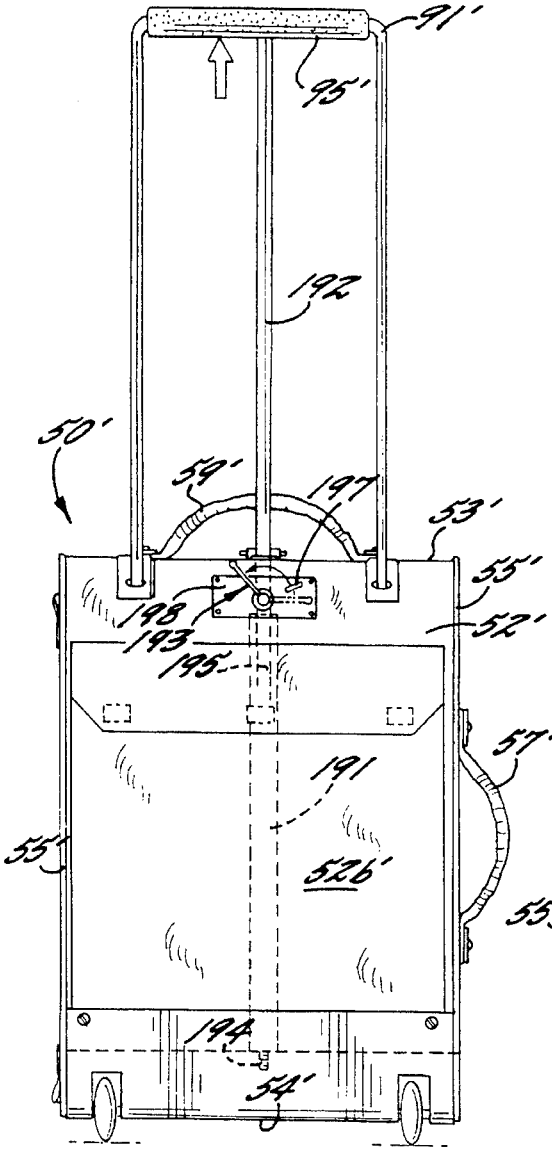
FIG. 36 illustrates a rear elevational view of a second embodiment of wheeled luggage according to the present invention having a handle thereof in an extended position.
Figure 37:
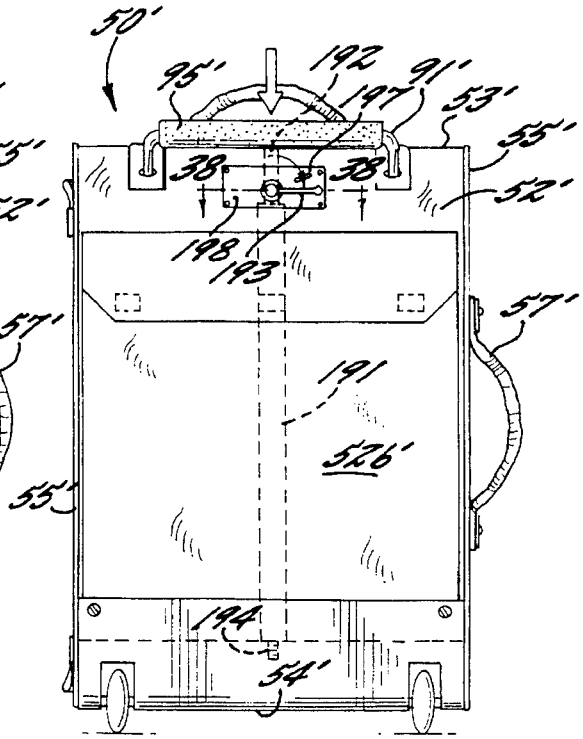
FIG. 37 illustrates a rear elevational view of a second embodiment of wheeled luggage according to the present invention having a handle thereof in a retracted position.
Figure 38:
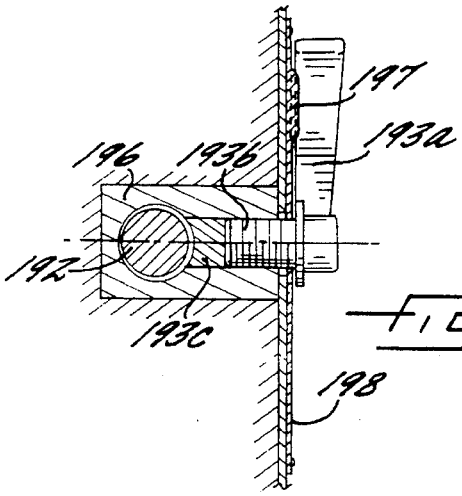
FIG. 38 illustrates an enlarged fragmentary view of portions of a handle of a second embodiment of wheeled luggage according to the present invention.

FIGS. 36–38 illustrate a second embodiment of wheeled luggage 50' according to the present invention. The wheeled luggage 50' in this embodiment has a cylinder 191, i.e., gas pressurized cylinder preferably having a pressure greater than atmospheric pressure, and a piston 192 slidably positioned and operable within a piston chamber 195 of the cylinder 191. The cylinder 191 is secured to the frame 60' of the wheeled luggage 50' by a fastening means 194 illustrated in the form of a threaded lower portion of the cylinder 191 inserted through an opening in the wheel mounting member 61' and secured thereto, i.e., by a nut positioned on an opposite side thereof. An upper end portion of the piston 192 is similarly secured to an upper end portion 91' of the handle 90', using means for fastening such as a threaded portion of piston 192 engaged with a securing nut, a screw engaged within a threaded hole in an upper end of piston 192, and other fastening means. Locking means illustrated in the form of a lever-lock 193 is connected to a rearward portion of the body portion along a plate member 198. The lever-lock 193 has a handle member 193 secured to a threaded shaft 193*b*. The threaded shaft 193*b* is positioned within a housing 196 having a first opening therein to slideably receive the piston 192. The housing 196 also has a second opening positioned generally perpendicular to the first opening and threadably receiving the threaded shaft 193*b*. A piston engaging member 193*c* is slidably positioned in the second opening between the piston 192 and the threaded shaft 193*b* to abuttingly engage the piston 192 during pressure received from the threaded shaft 193 during rotation by the handle member 193*a* along the direction of the arrow as illustrated. The lever-lock 193 thereby slidably engages the piston 192 to lock the handle 90' in an extended or retracted position, or partial positions thereof. A stop member 197 is formed integral with the plate member 198 to prevent sudden rotation of the handle member 193*a* to release the piston 192 and to provide a locking and/or guiding indicator for the traveller. By a traveller engaging the lever-lock 193 and releasing it in various positions, the handle 90' may be secured in a chosen position, i.e., fully or partially extended. It will also be understood by those skilled in the art that, other types of gas, air or hydraulic cylinders may be used, the relative positions of the cylinder 191 and piston 192 may be reversed, and/or other locking means such as a latch or various valve systems, used.

A method of connecting and positioning at least three pieces of luggage for airline travel is also provided according to the present invention, and more particularly as illustrated in FIGS. 4, 9, and 10. The method preferably includes connecting a first piece of luggage, such as the luggage case 200, to be positioned closely adjacent rearward portions of a second piece of luggage, such as the foldable garment bag 100, so that the first and second pieces of luggage 200, 100 together are sized to fit either underneath a passenger's seat UA or in an overhead storage area 0A in the passenger compartment of an airplane. The second piece of luggage 100 is then connected to a third piece of luggage, such as the wheeled luggage 50 illustrated also sized to fit either underneath a passenger's seat or in an overhead storage area in the passenger compartment of an airplane, so that the first piece of luggage 200 is positioned between the rearward portions of the second piece 100 of luggage and forward portions of the third piece of luggage 50.

According to another method of the present invention, as best illustrated in FIGS. 33 and 34, a luggage case 200 is connected within the confines of the foldable garment bag 100' so that the luggage case 200 and the foldable garment bag 100' together are sized to fit either underneath UA a passenger's seat or in an overhead storage area OA in the passenger compartment of an airplane. The foldable garment bag 100' is then connected to forward portions of wheeled luggage 50. The wheeled luggage 50 is also sized to fit either underneath UA a passenger's seat or in an overhead storage area OA so that the luggage case 200 positioned within the confines of the garment bag 100' and the foldable garment bag together are connected to forward portions of the wheeled luggage 50.

In the drawings and specification, there have been disclosed typical preferred embodiments of the invention, and, although specific terms have been employed, they have been used in a descriptive sense only and not for purposes of limitations. The invention has been described in considerable detail with specific reference to various illustrated embodiments. It will be apparent, however, that various modifications and changes can be made within the spirit and scope of the invention as described in the foregoing specification and defined in the appended claims.

That which is claimed:

1. A modular wheeled luggage system arranged to be positioned in a storage space underneath an airline seat or in an overhead storage compartment within a passenger compartment of an airplane, the luggage system comprising:

a first piece of luggage sized to be positioned underneath a passenger's seat or in an overhead storage area above a passenger's seat, said first piece of luggage including a body having overall respective length, width, and depth dimensions of no greater than 24-inches by 16-inches by 10-inches, and wheels connected to lower end portions of said body and a luggage connector detachably connected to said body for detachably connecting additional luggage thereto, said luggage connector including a first elongate strap having a first end portion including means for detachably connecting to portions of said body and longitudinally extending outwardly therefrom and a second elongate strap connected along medial portions thereof to a second end portion of said first elongate strap and transversely extending outwardly from said first elongate strap, said second elongate strap having a first pair of connectors secured thereto;

a second piece of luggage detachably connected to said luggage connector of said first piece of luggage and positioned adjacent and overlying portions of said body of said first piece of luggage, said second piece of luggage having a body sized so that said body of said second piece of luggage has dimensions substantially no greater than said body of said first piece of luggage and means connected to said body of said second piece of luggage for detachably connecting an additional piece of luggage thereto, said second piece of luggage further having a second pair of connectors secured to said body of said second piece of luggage and arranged to matingly receive said first pair of connectors secured to said second elongate strap of said luggage connector, said luggage connector of said first piece of luggage further including a third elongate strap having first and second end portions, said first end portion including means for detachably connecting to medial portions of said first elongate strap and longitudinally extending outwardly therefrom so as to overlie said second piece of luggage, said second end portion having a connector secured to said second end portion for connecting additional pieces of luggage thereto; and a third piece of luggage detachably connected to said connecting means of said second piece of luggage and sized so that said luggage case has dimensions substantially no greater than either said second piece of luggage or said body of said first piece of luggage, said third piece of luggage being detachably connected to said second piece of luggage so that when said second piece of luggage is disconnected from said luggage connector of said first piece of luggage said third piece of luggage remains connected to said second piece and whereby said second and third piece of luggage together are sized to have overall respective length, width, and depth dimensions no greater than 24-inches by 16-inches by 10-inches.

2. A modular wheeled luggage system as defined in claim 1, wherein said second piece of luggage comprises a foldable garment bag having a pair of main longitudinally extending panels formed of a fabric, said main fabric panels being longitudinally connected along a main common fold line, each of said main fabric panels having respectively mating connectors arranged to connect to the other corresponding main fabric panel upon folding along said main common fold line and arranged to receive clothing therein.

3. A modular wheeled luggage system as defined in claim 2, wherein at least one of said main fabric panels of said foldable garment bag includes a medial fabric panel and first and second side fabric panels respectively connected along a pair of common transverse fold lines extending the width of said main fabric panel so that each of said side fabric panels foldably overlie said medial fabric panel, and said means for connecting said third piece of luggage includes portions of at least one of said side fabric panels having a pair of connectors secured thereto and arranged to receive said third piece of luggage.

4. A modular wheeled luggage system as defined in claim 3, wherein said foldable garment bag further includes a carrying case positioned to overlie at least one of said medial fabric panels positioned between said pair of transverse fold lines when said main fabric panels are connected together, said carrying case having a handle and means for detachably connecting said handle to upper portions of said carrying case and positioned so that said side fabric panels of said foldable garment bag foldably overlie said carrying case.

5. A modular wheeled luggage system as defined in claim 3, wherein said foldable garment bag further comprises a pair of fold protectors connected to an inner surface of at least one of said main fabric panels and extending the substantial length of said pair of transverse fold lines which extend the width of said main fabric panel, said pair of fold protectors defining said medial fabric panel, extending above said inner surface, and being arrangedly positioned to overlie corresponding transverse fold lines of the other of said main fabric panels.

6. A modular wheeled luggage system arranged to be positioned in a storage space underneath an airline seat or in an overhead storage area above the passenger's seat on an airplane, the luggage system comprising:

wheeled luggage sized to be positioned underneath a passenger's seat or in an overhead storage area above a passenger's seat, said wheeled luggage including a body, wheels connected to lower end portions of said body, a retractable handle extendable upwardly from upper portions of said body, and means connected to said body for detachably connecting additional luggage thereto, said additional luggage connecting means including a first elongate strap having a first end portion detachably connected to portions of said body and longitudinally extending outwardly therefrom and a second elongate strap connected along medial portions thereof to a second end portion of said first elongate strap and transversely extending outwardly from said first elongate strap, said second elongate strap having a first pair of connectors secured thereto;

a foldable garment bag detachably connected to said connecting means of said wheeled luggage and positioned adjacent and overlying portions of said body of said wheeled luggage, said foldable garment bag having a body sized so that when in a folded position has dimensions substantially no greater than said body of said wheeled luggage and means connected to said garment bag body for detachably connecting an additional piece of luggage thereto, said garment bag further having a second pair of connectors secured to said body of said foldable garment bag and arranged to matingly receive said first pair of connectors secured to said second elongate strap of said additional luggage connecting means, said luggage connecting of said first piece of luggage further including a third elongate strap having first and second end portions, said first end portion being detachably connected to medial portions of said first elongate strap and longitudinally extending outwardly therefrom so as to overlie said garment bag, said second end portion having a connector secured to said second end portion for connecting additional pieces of luggage thereto; and a luggage case positioned between said garment bag and said body of said wheeled luggage, overlying portions of said body of said wheeled luggage, detachably connected to said connecting means of said foldable garment bag, and sized so that said luggage case has dimensions no greater than either said folded garment bag or said body of said wheeled luggage, said luggage case being detachably connected to said garment bag so that when said garment bag is released from said connecting means of said wheeled luggage said luggage case remains connected to said garment bag.

7. A modular wheeled luggage system as defined in claim 6, wherein said foldable garment bag includes a pair of main longitudinally extending panels formed of a fabric, said main fabric panels being longitudinally connected along a main common fold line, each of said main fabric panels having respectively mating connectors arranged to connect to the other corresponding main fabric panel upon folding along said main common fold line and arranged to receive clothing therein.

8. A modular wheeled luggage system as defined in claim 7, wherein at least one of said main fabric panels of said foldable garment bag includes a medial fabric panel and first and second side fabric panels respectively connected along a pair of common transverse fold lines extending the width of said main fabric panel so that each of said side fabric panels foldably overlie said medial fabric panel, said connecting means of said garment bag includes outer portions of said second side panel having a pair of connectors secured thereto and arranged to receive said luggage case thereby detachably connecting said luggage case to rear portions of said foldable garment bag when in a folded position.

9. A modular wheeled luggage system as defined in claim 8, wherein said foldable garment bag further includes a carrying case positioned to overlie at least one of said medial fabric panels between said pair of transverse fold lines when said main fabric panels are connected together, said carrying case having a handle and means for detachably connecting said handle to upper portions of said carrying case so that when said foldable garment bag is in a folded position whereby said side fabric panels foldably overlie said carrying case said foldable garment bag is supported by said carrying case when said carrying case is suspended by said handle.

10. A modular wheeled luggage system as defined in claim 8, wherein said foldable garment bag further comprises a pair of fold protectors connected to an inner surface of at least one of said main fabric panels and extending the substantial length of said pair of common transverse fold lines which extend the width of said main fabric panel, said pair of fold protectors defining said medial fabric panel, extending above said inner surface, and being arrangedly positioned to overlie corresponding common transverse fold lines of the other of said main fabric panels.

11. A modular wheeled luggage system as defined in claim 8, wherein said wheeled luggage is sized to have overall respective length, width, and depth dimensions no greater than 24-inches by 16-inches by 10-inches, and wherein said foldable garment bag when folded and said luggage case connected thereto together are sized to have overall respective length, width, and depth dimensions no greater than 24-inches by 16-inches by 10-inches.

12. A modular wheeled luggage system as defined in claim 6, wherein said wheeled luggage is sized to have overall respective length, width, and depth dimensions no greater than a regulating authority's guidelines or regulations, and wherein said foldable garment bag when folded and said luggage case connected thereto together are sized to have overall respective length, width, and depth dimensions no greater than a regulating authority's guidelines or regulations.

13. A modular wheeled luggage system arranged to be positioned in a storage space underneath an airline seat or in an overhead storage compartment within the passenger compartment of an airplane, the luggage system comprising:

a wheeled luggage sized to be positioned underneath a passenger's seat or in an overhead storage area above a passenger's seat and having overall respective length, width, and depth dimensions of no greater than 24-inches by 16-inches by 10-inches, said wheeled luggage including a body portion, wheels connected to rearward lower end portions of said body, a luggage connector detachably connected to said body for detachably connecting additional luggage to forward portions thereof, said luggage connector including a first elongate strap having a first end portion including means for detachably connecting to portions of said body and longitudinally extending outwardly therefrom and a second elongate strap connected along medial portions thereof to a second end portion of said first elongate strap and transversely extending outwardly from said first elongate strap, said second elongate strap having a first pair of connectors secured thereto;

a tri-fold garment bag detachably connected to said luggage connector of said wheeled luggage and positioned adjacent and overlying forward portions of said body of said wheeled luggage, said tri-fold garment bag having a body when in a folded position approximates the circumferential size of said body of said wheeled luggage, said tri-fold garment bag including means for detachably connecting additional luggage thereto, a pair of main longitudinally extending panels formed of a fabric, said main fabric panels being longitudinally connected along a main common fold line, each of said main fabric panels having respectively mating connectors arranged to connect to the other corresponding main fabric panel upon folding along said main common fold line and arranged to receive clothing therein, and a second pair of connectors secured to said body of said tri-fold garment bag and positioned to matingly receive said first pair of connectors secured to said second elongate strap of said luggage connector, said luggage connector of said wheeled luggage further including a third elongate strap having first and second end portions, said first end portion including means for detachably connecting to medial portions of said first elongate strap and longitudinally extending outwardly therefrom so as to overlie said tri-fold garment bag, said second end portion having a connector secured to said second end portion for connecting additional pieces of luggage thereto; and a luggage case having major portions thereof surrounded by said main fabric panels of said tri-fold garment bag, detachably connected to said connecting means of said tri-fold garment bag, and sized so that said luggage case has a circumferential size of no greater than either said tri-fold garment bag when in a folded position or said body of said wheeled luggage, said luggage case being detachably connected to said tri-fold garment bag so that when said tri-fold garment bag is disconnected from said luggage connector of said wheeled luggage said luggage case remains connected to said tri-fold garment bag and whereby said tri-fold garment bag when folded and said luggage case together are sized to have overall respective length, width, and depth dimensions no greater than 24-inches by 16-inches by 10-inches.

14. A modular wheeled luggage system as defined in claim 13, wherein at least one of said main fabric panels of said tri-fold garment bag includes a medial fabric panel and first and second side fabric panels respectively connected along a pair of common transverse fold lines extending the width of said main fabric panel so that each of said side fabric panels foldably overlie said medial fabric panel, outer portions of at least one of said panels having a pair of fabric flaps and connectors respectively secured thereto and arranged to receive said luggage case thereby detachably connecting said luggage case to said tri-fold garment bag when in a folded position.

15. A modular wheeled luggage system as defined in claim 14, wherein said tri-fold garment bag further includes a carrying case positioned to overlie said medial fabric panel between said pair of transverse fold lines when said main fabric panels are connected together, said carrying case having a handle and means for detachably connecting said handle to upper portions of said carrying case and arranged to support said tri-fold garment bag when in a folded position and whereby said side fabric panels foldably overlie said carrying case.

16. A modular wheeled luggage system as defined in claim 15, wherein said tri-fold garment bag further comprises a pair of fold protectors connected to an inner surface of at least one of said main fabric panels and extending the substantial length of said pair of common transverse fold lines which extend the width of said main fabric panel, said pair of fold protectors defining said medial fabric panel, extending above said inner surface, and being arrangedly positioned to overlie a corresponding pair of transverse fold lines of the other of said main fabric panels.

17. A modular wheeled luggage system as defined in claim 16, wherein said wheeled luggage further comprises a retractable handle extendable upwardly from upper portions of said body portion and means connected to said upper portions of said body portion and said handle for respectively extending and retracting said handle upwardly from and downwardly toward said body portion of said wheeled luggage, said extending and retracting means comprising a piston chamber and a piston operable within said piston chamber.

18. A modular wheeled luggage system as defined in claim 17, wherein said extending and retracting means further comprises a pressurized cylinder having said piston chamber positioned within inner portions thereof, said pressurized cylinder and piston being connected to said body portion and said handle of said wheeled luggage.

19. A modular wheeled luggage system as defined in claims 18, wherein said pressurized cylinder has a lower end connected to a lower end portion of said body portion and an upper end connected to an upper end portion of said body portion, said piston having a lower end slidably positioned within confines of said pressurized cylinder and an upper end secured to an upper end portion of said handle, said pressurized cylinder biasing said piston in an extended position absent an external force applied thereto, and said extending and retracting means further comprising locking means connected to said body portion and engaging said piston for locking said handle in a predetermined position.

20. A foldable garment bag comprising:

a pair of main longitudinally extending panels formed of a fabric material, said main fabric panels being longitudinally connected along a main common fold line and arranged to receive clothing therein;

first matingly connecting means connected to each of said main fabric panels for matingly connecting said pair of main fabric panels upon folding along the main common fold line;

at least one of said main fabric panels including a medial fabric panel and first and second side fabric panels respectively connected along a pair of transverse fold lines extending the width of said main fabric panel so that each of said side fabric panels foldably overlie said medial fabric panel;

second matingly connecting means connected to outer portions of one of said side panels;

a pair of fabric flaps secured to portions of at least one of said panels and arranged to receive a luggage case therein, said pair of fabric flaps and said second matingly connecting means being arranged to detachably connect a luggage case to rear portions of the foldable garment bag when in a folded position; and a pair of fold protectors connected to an inner surface of at least one of said main fabric panels and extending the substantial length of said pair of transverse fold lines which extend the width of said main fabric panel, said pair of fold protectors defining said medial fabric panel, extending above said inner surface, and being positioned to overlie a corresponding pair of transverse fold lines of the other one of said main fabric panels, each of said pair of fold protectors including an elongate fabric compartment having an upstanding elongate foam member positioned therein so that said fabric compartment extends above said inner surface of said main fabric panel.

21. A foldable garment bag as defined in claim 20, further comprising a carrying case positioned to overlie said medial fabric panel between said pair of transverse fold lines when said main fabric panels are connected together by said first matingly connecting means, said carrying case having a handle and means for detachably connecting said handle to upper portions of said carrying case and arranged so that when said foldable garment bag is in a folded position whereby said side fabric panels foldably overlie said carrying case, said foldable garment bag is supported by said carrying case when said carrying case is suspended by said handle.

22. A foldable garment bag as defined in claim 20, wherein said upstanding elongate foam member has a channel longitudinally extending therethrough and positioned closely adjacent said inner surface of said main fabric panel so that external folding pressure along the respective transverse fold line responsively only allows the fold to extend inwardly toward and within the confines of the foam member.

23. A luggage connector arranged to be detachably secured to a piece of luggage, the luggage connector comprising:

a first elongate strap having first and second end portions, said first end portion positioned to detachably connect to a first piece of luggage and extend longitudinally and outwardly therefrom;

a second elongate strap connected along medial portions thereof to said second end portion of said first elongate strap and extending transversely and outwardly from said first elongate strap, said second elongate strap having a pair of connectors secured thereto and arranged to detachably connect to a second piece of luggage positioned adjacent forward portions of a first piece of luggage;

a third elongate strap having first end portion and second end portions, said first end portion including means for detachably connecting to said first elongate strap and longitudinally extending outwardly therefrom, said third elongate strip having a connector secured to said second end portion thereof and arranged to connect to a third piece of luggage positioned closely adjacent forward portions of a second piece of luggage.

24. A luggage connector as defined in claim 23, wherein said detachable connecting means of said first end portion of said third elongate strap is further positioned to detachably connect to a first piece of luggage and said second end portion is positioned to connect to a third piece of luggage thereby positioning the third piece of luggage closely adjacent forward portions of the first piece of luggage.

* * * * *